US006320560B1

(12) United States Patent
Sasaki et al.

(10) Patent No.: US 6,320,560 B1
(45) Date of Patent: Nov. 20, 2001

(54) PLASMA DISPLAY, DRIVING APPARATUS OF PLASMA DISPLAY PANEL AND DRIVING SYSTEM THEREOF

(75) Inventors: Takashi Sasaki, Hiratsuka; Masaji Ishigaki, Yokohama; Takahisa Mizuta, Yokohama; Takeo Masuda, Yokohama, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 08/941,098

(22) Filed: Oct. 8, 1997

(30) Foreign Application Priority Data

Oct. 8, 1996 (JP) ..... 8-267264
Dec. 11, 1996 (JP) ..... 8-330596

(51) Int. Cl.[7] ..... G09G 3/28

(52) U.S. Cl. ..... 345/60; 345/68; 345/63; 315/169.1; 315/169.2; 315/169.3; 315/169.4

(58) Field of Search ..... 315/169.1, 169.2, 315/169.3, 169.4; 345/60, 63, 68, 41, 42

(56) References Cited

U.S. PATENT DOCUMENTS

| | | | | |
|---|---|---|---|---|
| 5,446,344 | | 8/1995 | Kanazawa | 315/169.4 |
| 5,656,893 | * | 8/1997 | Shino et al. | 315/169.4 |
| 5,663,741 | * | 9/1997 | Kanazawa | 345/66 |
| 5,745,086 | * | 4/1998 | Weber | 345/63 |
| 5,889,501 | * | 3/1999 | Sasaki et al. | 345/60 |

FOREIGN PATENT DOCUMENTS

| | | |
|---|---|---|
| 0 657 861 A1 | 6/1995 | (EP) . |
| 6-186927 | 8/1994 | (JP) . |
| 7-49663 | 2/1995 | (JP) . |
| 8-63123 | 3/1996 | (JP) . |
| 8-160910 | 6/1996 | (JP) . |

OTHER PUBLICATIONS

"Plasma Display", Kyouritu Shuppan Co.

* cited by examiner

*Primary Examiner*—Bipin Shalwala
*Assistant Examiner*—Jimmy H. Nguyen
(74) *Attorney, Agent, or Firm*—Antonelli, Terry, Stout & Kraus, LLP

(57) ABSTRACT

A plasma display panel driving system having common X electrodes arranged on a front glass substrate driven in common, independent Y electrodes arranged parallel to the common X electrodes on the front glass substrate driven independently, address A electrodes arranged perpendicular to the common X electrodes and the independent Y electrodes on the back glass substrate driven independently, and means for performing at least one electric discharge for equalizing electrically charged particles in a cell in which another electrically charged particle is produced beforehand, thereby improving contrast. Erasing and polarization of electrically charged particles are performed by a fine line erasing pulse after a sustaining period, and an equalizing pulse having a high voltage level is supplied to the independent Y electrode to which the last fine line erasing pulse is supplied, and a regulating pulse is supplied to the common X electrode after supplying the equalizing pulse. Further, a field block having plurality of sub-fields are provided, and a full writing electric discharge and a fine line erasing electric discharge are performed in the first sub-field of each field block for reducing the number of electric discharges.

9 Claims, 27 Drawing Sheets

TIME
COLUMNS OF CELLS
Grd
EQUALIZING PERIOD
ADDRESS PERIOD
SUSTAIN PERIOD

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
40 41 42 43a 43b 44a 44b 45a 45b 70 71 72 73 74 75a 75b
Grd

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
40 41 42 43a 43b 44a 44b 45a 45b 80 81 82 83 84 85a 85b 86a 86b
Grd

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
94
90
41
Grd
42
91
43a
92
45a
46a
44a
43b
93
45b
46b
44b

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
94
100
41
Grd
42
101
43a
102
45a
46a
104a
43b
103
45b
46b
104b

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
114
115
110
41
Grd
42
111
43a
112
45a
46a
116a
43b
113
45b
46b
116b

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
134 135 41
130
Grd
42
131
Grd
45a 46a
132
136a
137a
Grd
45b 46b
133
136b
137b
Grd

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
144
135
140
41
42
141
142
143
136a
136b
137a
137b
45a
45b
46a
46b
Grd

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
153 154 150 41 155
Grd
42 151
156a 152 45a 137a
156b 153 45b 137b

COLUMNS OF CELLS
TIME
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
164
165
160
41
155
Grd
42
161
156a
162
45a
137a
156b
163
45b
137b

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
40
41
170
171
172
173
174
175
43a
43b
44a
44b
45a
45b
46a
46b
Grd

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
184
41
180
Grd
42
181
43a
45a
46a
182
185a
43b
45b
46b
183
185b

TIME
COLUMNS OF CELLS
1
2 3 4 5 6 7 8 9
2a 2b 2c 3a 3b 3c 4a 4b 4c 5a 5b 5c 6a 6b 6c 7a 7b 7c 8a 8b 8c 9a 9b 9c 9d
40
190
41
194
Grd
42
191
43a
192
44a
45a
195a
43b
193
44b
45b
195b

TIME
COLUMNS OF CELLS
Grd

PLASMA DISPLAY, DRIVING APPARATUS OF PLASMA DISPLAY PANEL AND DRIVING SYSTEM THEREOF

BACKGROUND OF THE INVENTION

The invention relates to plasma display, driving apparatus of plasma display panel and driving system thereof for, for example, display apparatus of personal computer or workstation, a flat type wall hanging television receiver and a display apparatus for advertising and information. This invention is preferably applicable to AC type plasma display.

In plasma display, one field is divided into several sub-fields, and each pixel (cell) is given forth light by exciting a phosphor by ultraviolet rays that are generated by a electric discharge carried out in the cell. The cell that emits light is practiced by an address electric discharge between two set of electrodes which are provided perpendicular to each other on a front side glass substrate and a back side glass substrate respectively and are capable of driving independently.

A first prior art relating to a plasma display is disclosed, for example, Japanese Patent Application Laid-Open No. 1994/186927. In the prior art, the condition of the electric charge particles in all cells is equalized for surely prohibiting lighting for some cells which are not intended to emit light, and two sets of light emitting discharges, that is, a full writing electric discharge and a full erasing electric discharge in each sub-field are carried out so as to be able to use low voltage for an address electric discharge. Therefore, the contrast is deteriorated because light emitting occurs on full panel when black is displayed.

A second prior art is disclosed, for example, Japanese Patent Application Laid-Open No. 1995/49663. In the prior art, the plurality of the sub-fields having the same brightness gradations are arranged to construct a sub-field block, and several blocks are provided. In sub-field blocks, a preliminary discharge including a full writing electric discharge and a fine line erasing electric discharge is performed in one sub-field, and a writing electric discharge and a erasing electric discharge to a pixel is carried out one time. Therefore, deterioration of a panel is reduced and contrast of a display is improved. The second prior art discloses one of the solution to improve the contrast, but no prior art is shown to improve the contrast in which plural sub-fields having different brightness gradations for constructing one sub-field block.

About 3 $\mu$sec to 4 $\mu$sec is needed to write one line of plasma panel, and an ordinal television display has 480 lines. A writing period of a screen is 1.44 msec if a writing period of one line is 3 $\mu$sec, so that 1.44 msec$\times$9$\approx$13 msec is needed for one field. The period of one field is 16.7 msec. A sustaining period is 16.7 msec minus a writing period and preliminary discharge period, and this period is not so long enough. Further, if a display has 760 lines per a screen like a high definition display, or if a display has 8 sub-fields for constructing 256 gradations, period for writing is not sufficient.

SUMMARY OF THE INVENTION

It is an object of the present invention to improve contrast.

It is another object of the present invention to improve contrast by reducing a full erasing electric discharge and full writing electric discharge.

It is still another object of the invention to improve contrast by reducing preliminary discharge without changing the number of sub-fields.

According to a feature of the present invention, to achieve the above object, a plasma display and a plasma display driving system include a first electrode group arranged on a permeable substrate and being capable of driving in common, a second electrode group arranged in parallel with the first electrode group on the permeable substrate and being capable of driving independently, a third electrode group arranged perpendicular to the first and second electrode groups on the other substrate and being capable of driving independently, and the plasma panel and the driving system comprising means for performing at least one electric discharge for equalizing electric charge particles in a cell in which another electric charge particle is caused beforehand.

According to another feature of the present invention, to achieve the above object, a plasma display, and a plasma display panel driving system and circuit include a first electrode group driven in common, a second electrode group driven independently, a third electrode group for an address electric discharge, means for erasing and polarizing electric charge particles by a find line erasing pulse after sustaining period and for supplying an equalizing pulse to one of the electrode group of the first and second electrode group to which the last fine line erasing pulse is supplied and for supplying a regulating pulse to the other electrode of the first and the second electrode groups after supply of the equalizing pulse, thereby controlling the electric charge particles without full erasing electric discharge and full writing electric discharge and improving contrast without light emitting discharge in case of displaying of black color.

According to still another feature of the present invention, to achieve the above object, a plasma display and a plasma display panel driving system and circuit include means for constructing a field block from plurality of sub-fields and for performing a full writing electric discharge and a fine line erasing electric discharge in first sub-field of the field block for decreasing number of electric discharge, means for gathering positive electric charge particles in the vicinity of an address electrode by the full writing electric discharge and fine line erasing electric discharge thereby decreasing a voltage of an address pulse, and means for reproducing the condition of electric charge particles the same as the condition after performing full writing electric discharge and fine line erasing electric discharge are performed by utilizing a sustaining electric discharge in a cell in which the address electric discharge occurred, thereby reducing the voltage of a address electric discharge in the next field without the full writing electric discharge and the fine line electric discharge. In a cell having no address electric discharge, the condition of electric charge particles after the full writing electric discharge and fine line erasing electric discharge are performed is maintained during one field, so that it is sufficient to perform one time of the full writing electric discharge and fine line electric discharge.

These and other objects, features and advantages of the present invention will become more apparent form the following description when taken in conjunction with the accompanying drawings.

BRIEF DESCRIPTION OF THE DRAWINGS

FIG. 5(*b*) illustrates a driving wave-form supplied to a common X electrode in accordance with the first embodiment of the present invention.

FIG. 5(*c*) illustrates a driving wave-form supplied to an address A electrode in accordance with the first embodiment of the present invention.

FIG. 5(*d*) illustrates a driving wave-form supplied to a first independent Y electrode in accordance with the first embodiment of the present invention.

FIG. 5(*e*) illustrates a driving wave-form supplied to a second independent Y electrode in accordance with the first embodiment of the present invention.

FIG. 11(*b*) illustrates a driving wave-form supplied to a common X electrode in accordance with the second embodiment of the present invention.

FIG. 11(*c*) illustrates a driving wave-form supplied to an address A electrode in accordance with the second embodiment of the present invention.

FIG. 11(*d*) illustrates a driving wave-form supplied to a first independent Y electrode in accordance with the second embodiment of the present invention.

FIG. 11(*e*) illustrates a driving wave-form supplied to a second independent Y electrode in accordance with the second embodiment of the present invention.

FIG. 12(*b*) illustrates a driving wave-form supplied to a common X electrode in accordance with the third embodiment of the present invention.

FIG. 12(*c*)illustrates a driving wave-form supplied to an address A electrode in accordance with the third embodiment of the present invention.

FIG. 12(*d*) illustrates a driving wave-form supplied to a first independent Y electrode in accordance with the third embodiment of the present invention.

FIG. 12(*e*) illustrates a driving wave-form supplied to a second independent Y electrode in accordance with the third embodiment of the present invention.

FIG. 13(*b*) illustrates a driving wave-form supplied to a common X electrode in accordance with the fourth embodiment of the present invention.

FIG. 13(*c*) illustrates a driving wave-form supplied to an address A electrode in accordance with the fourth embodiment of the present invention.

FIG. 13(*d*) illustrates a driving wave-form supplied to a first independent Y electrode in accordance with the fourth embodiment of the present invention.

FIG. 13(*e*) illustrates a driving wave-form supplied to a second independent Y electrode in accordance with the fourth embodiment of the present invention.

FIG. 14(*b*) illustrates a driving wave-form supplied to a common X electrode in accordance with the fifth embodiment of the present invention.

FIG. 14(*c*) illustrates a driving wave-form supplied to an address A electrode in accordance with the fifth embodiment of the present invention.

FIG. 14(*d*) illustrates a driving wave-form supplied to a first independent Y electrode in accordance with the fifth embodiment of the present invention.

FIG. 14(*e*) illustrates a driving wave-form supplied to a second independent Y electrode in accordance with the fifth embodiment of the present invention.

FIG. 15(*b*) illustrates a driving wave-form supplied to a common X electrode in accordance with the sixth embodiment of the present invention.

FIG. 15(*c*) illustrates a driving wave-form supplied to an address A electrode in accordance with the sixth embodiment of the present invention.

FIG. 15(*d*) illustrates a driving wave-form supplied to a first independent Y electrode in accordance with the sixth embodiment of the present invention.

FIG. 15(*e*) illustrates a driving wave-form supplied to a second independent Y electrode in accordance with the sixth embodiment of the present invention.

FIG. 16(*b*) illustrates a driving wave-form supplied to a common X electrode in accordance with the seventh embodiment of the present invention.

FIG. 16(*c*) illustrates a driving wave-form supplied to an address A electrode in accordance with the seventh embodiment of the present invention.

FIG. 16(*d*) illustrates a driving wave-form supplied to a first independent Y electrode in accordance with the seventh embodiment of the present invention.

FIG. 16(*e*) illustrates a driving wave-form supplied to a second independent Y electrode in accordance with the seventh embodiment of the present invention.

FIG. 17(*b*) illustrates a driving wave-form supplied to a common X electrode in accordance with the eighth embodiment of the present invention.

FIG. 17(*c*) illustrates a driving wave-form supplied to an address A electrode in accordance with the eighth embodiment of the present invention.

FIG. 17(*d*) illustrates a driving wave-form supplied to a first independent Y electrode in accordance with the eight embodiment of the present invention.

FIG. 17(*e*) illustrates a driving wave-form supplied to a second independent Y electrode in accordance with the eight embodiment of the present invention.

FIG. 18(*b*) illustrates a driving wave-form supplied to a common X electrode in accordance with the ninth embodiment of the present invention.

FIG. 18(*c*) illustrates a driving wave-form supplied to an address A electrode in accordance with the ninth embodiment of the present invention.

FIG. 18(*d*) illustrates a driving wave-form supplied to a first independent Y electrode in accordance with the ninth embodiment of the present invention.

FIG. 18(*e*) illustrates a driving wave-form supplied to a second independent Y electrode in accordance with the ninth embodiment of the present invention.

FIG. 24(*b*) illustrates a driving wave-form supplied to a common X electrode in accordance with the tenth embodiment of the present invention.

FIG. 24(*c*) illustrates a driving wave-form supplied to an address A electrode in accordance with the tenth embodiment of the present invention.

FIG. 24(*d*) illustrates a driving wave-form supplied to a first independent Y electrode in accordance with the tenth embodiment of the present invention.

FIG. 24(*e*) illustrates a driving wave-form supplied to a second independent Y electrode in accordance with the tenth embodiment of the present invention.

FIG. 25(*b*) illustrates a driving wave-form supplied to a common X electrode in accordance with the eleventh embodiment of the present invention.

FIG. 25(*c*) illustrates a driving wave-form supplied to an address A electrode in accordance with the eleventh embodiment of the present invention.

FIG. 25(*d*) illustrates a driving wave-form supplied to a first independent Y electrode in accordance with the eleventh embodiment of the present invention.

FIG. 25(*e*) illustrates a driving wave-form supplied to a second independent Y electrode in accordance with the eleventh embodiment of the present invention.

FIG. 26(*b*) illustrates a driving wave-form supplied to a common X electrode in accordance with the twelfth embodiment of the present invention.

FIG. 26(*c*) illustrates a driving wave-form supplied to an address A electrode in accordance with the twelfth embodiment of the present invention.

FIG. 26(*d*) illustrates a driving wave-form supplied to a first independent Y electrode in accordance with the twelfth embodiment of the present invention.

FIG. 26(*e*) illustrates a driving wave-form supplied to a second independent Y electrode in accordance with the twelfth embodiment of the present invention.

FIG. 27(*b*) illustrates a driving wave-form supplied to a common X electrode in accordance with the thirteenth embodiment of the present invention.

FIG. 27(*c*) illustrates a driving wave-form supplied to an address A electrode in accordance with the thirteenth embodiment of the present invention.

FIG. 27(*d*) illustrates a driving wave-form supplied to a first independent Y electrode in accordance with the thirteenth embodiment of the present invention.

FIG. 27(*e*) illustrates a driving wave-form supplied to a second independent Y electrode in accordance with the thirteenth embodiment of the present invention.

FIG. 28(*b*) illustrates a driving wave-form supplied to a common X electrode in accordance with the fourteenth embodiment of the present invention.

FIG. 28(*c*) illustrates a driving wave-form supplied to an address A electrode in accordance with the fourteenth embodiment of the present invention.

FIG. 28(*d*) illustrates a driving wave-form supplied to a first independent Y electrode in accordance with the fourteenth embodiment of the present invention.

FIG. 28(*e*) illustrates a driving wave-form supplied to a second independent Y electrode in accordance with the fourteenth embodiment of the present invention.

FIG. 28(*f*) illustrates a driving wave-form supplied to a third independent Y electrode in accordance with the fourteenth embodiment of the present invention.

FIG. 28(*g*) illustrates a driving wave-form supplied to a fourth independent Y electrode in accordance with the fourteenth embodiment of the present invention.

DESCRIPTION OF THE PREFERRED EMBODIMENTS

The preferred embodiments of the present invention will be described with using drawings hereinafter.

Figure 1:
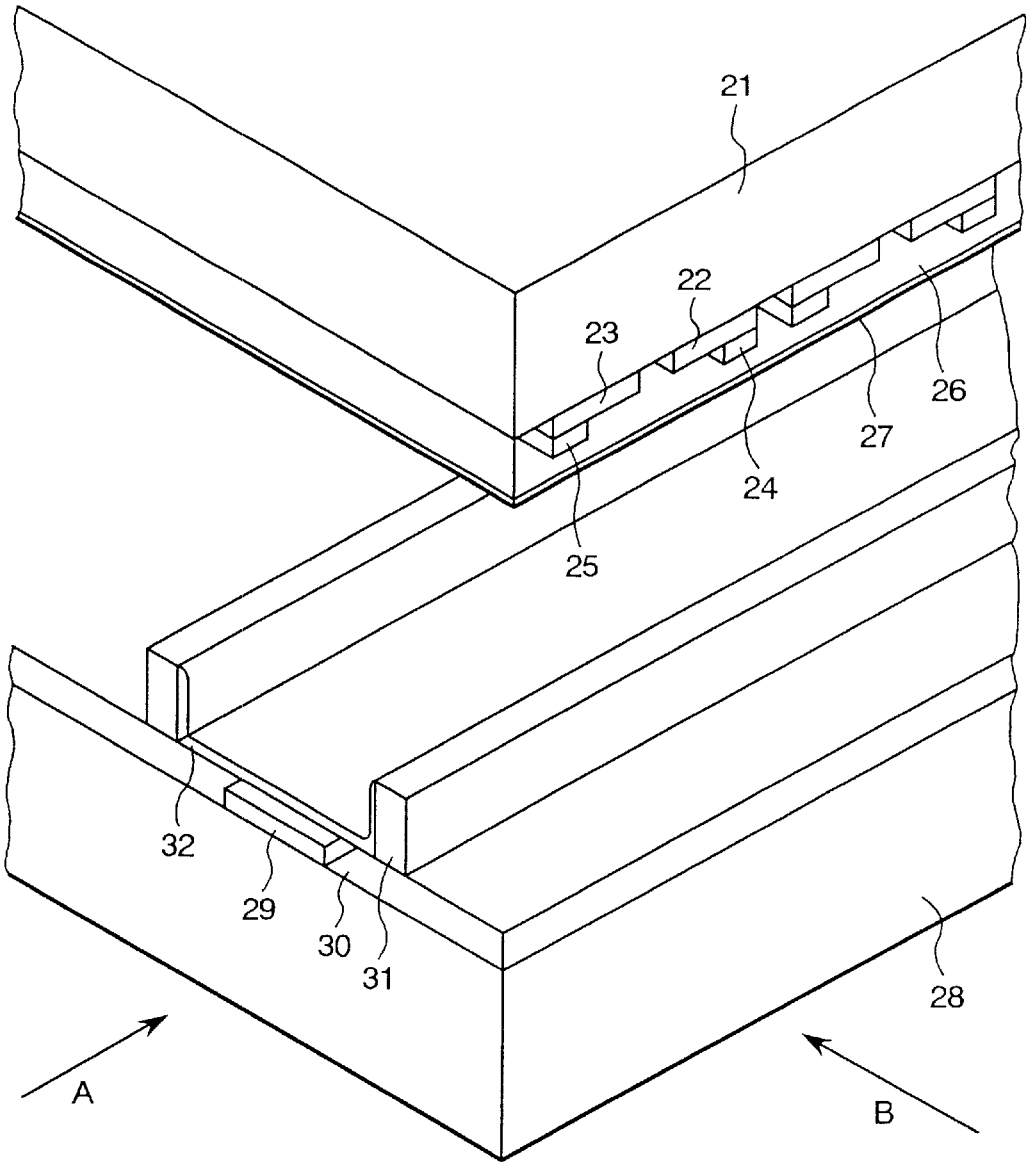
FIG. 1 is a exploded perspective view illustrating a plasma display panel of the present invention.

FIG. 1 illustrates a exploded perspective view of a plasma display panel relating to the first embodiment of the present invention.

A transparent common X electrode 22 and a transparent independent Y electrode 23 are provided under a front glass substrate 21, and a X bus electrode 24 and a Y bus electrode 25 are laminated on respective electrode 21 and 22. A dielectric layer 26 and a protecting layer 27 such as a acid magnesium (MgO) are provided on these electrodes 22,23, 24 and 25. An address A electrode 29 provided on a back glass substrate 28 is arranged perpendicular to the common X electrode 22 and the independent Y electrode 23 on the front glass substrate 21. The address A electrode 29 is covered by a dielectric layer 30 and a partition wall 31 arranged parallel to the address A electrode 29 is provided on the electrode 29. A phosphor 32 is coated on the partition wall 31 and the address A electrode 29.

Figure 2:
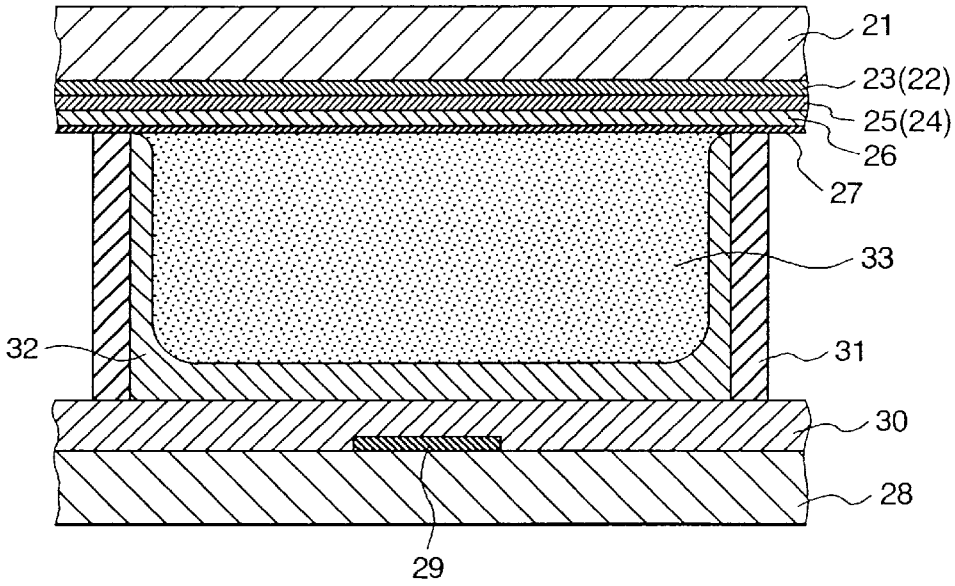
FIG. 2 is a sectional view of a plasma display panel which is illustrated from a direction in accordance with an arrow A of FIG. 1.

FIG. 2 is a sectional view of a plasma display panel which is illustrated from a direction in accordance with an arrow A of FIG. 1. The address A electrode 29 is arranged in the middle of the two partition walls. A discharge gas such as a neon gas or a xenon gas is filled in a space 33 that is provided between the front glass substrate 21 and the back glass substrate 38.

Figure 3:
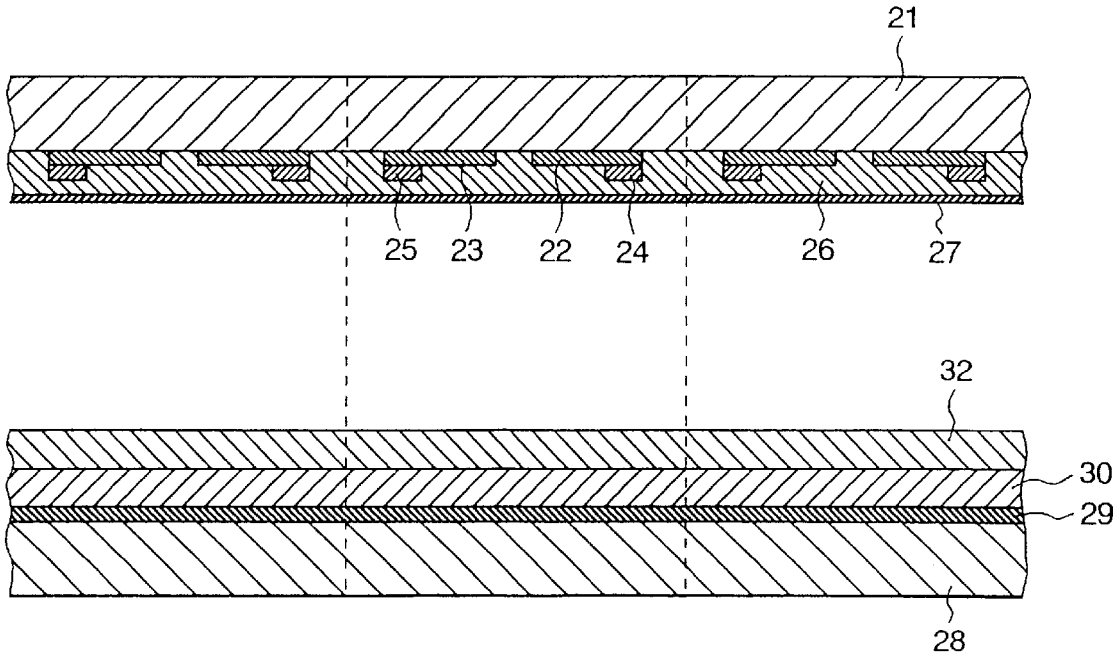
FIG. 3 is a sectional view of a plasma display panel which is illustrated from a direction in accordance with an arrow of FIG. 1.

FIG. 3 is a sectional view of a plasma display panel which is illustrated from a direction in accordance with an arrow of FIG. 1. A border of each cell is shown by a dotted line, and the common X electrode 22 and the independent Y electrode 23 are arranged alternatively. In AC type plasma display panel, the electric charge particles on the dielectric layer in the vicinity of the common X electrode 22 and the independent Y electrode 23 are divided into positive electric charge particles and negative electric charge particles for forming an electric field, so that a discharge is performed by using the electric field.

Figure 4:
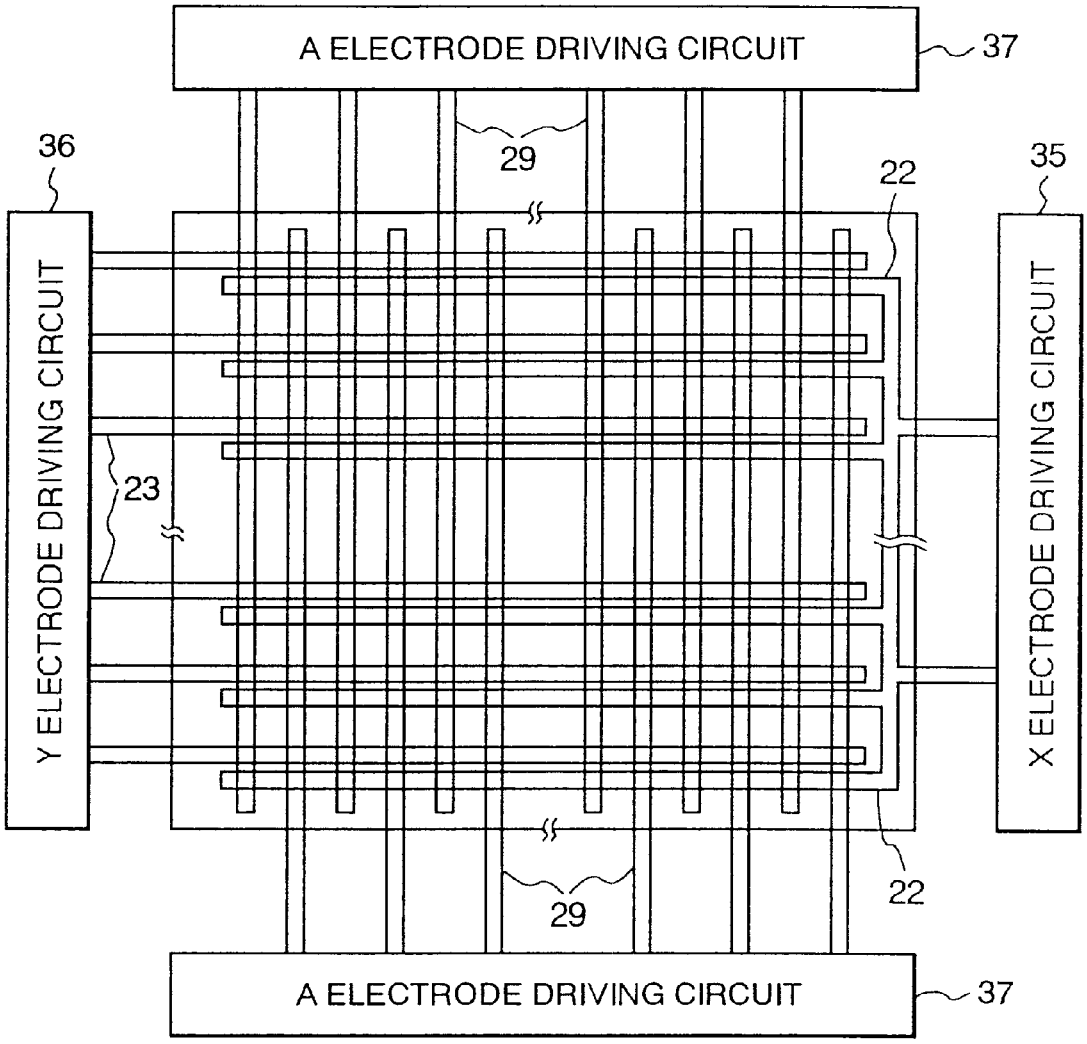
FIG. 4 illustrates electrodes and circuits connected to the electrodes of the plasma display panel of FIG. 1.

FIG. 4 illustrates electrodes and circuits connected to the electrodes of the plasma display panel of FIG. 1. The common X electrode 22 is connected to an output terminal or several terminals of a X electrode driving circuit 35 that generates a driving pulse for supplying to the common X electrode 22. Each independent Y electrode 23 is connected respective output terminals of a Y electrode driving circuit 36. Each address A electrode 29 is connected respective output terminals of a A electrode driving circuit 37.

Figures 5A, 5B, 5C, 5D, 5E:
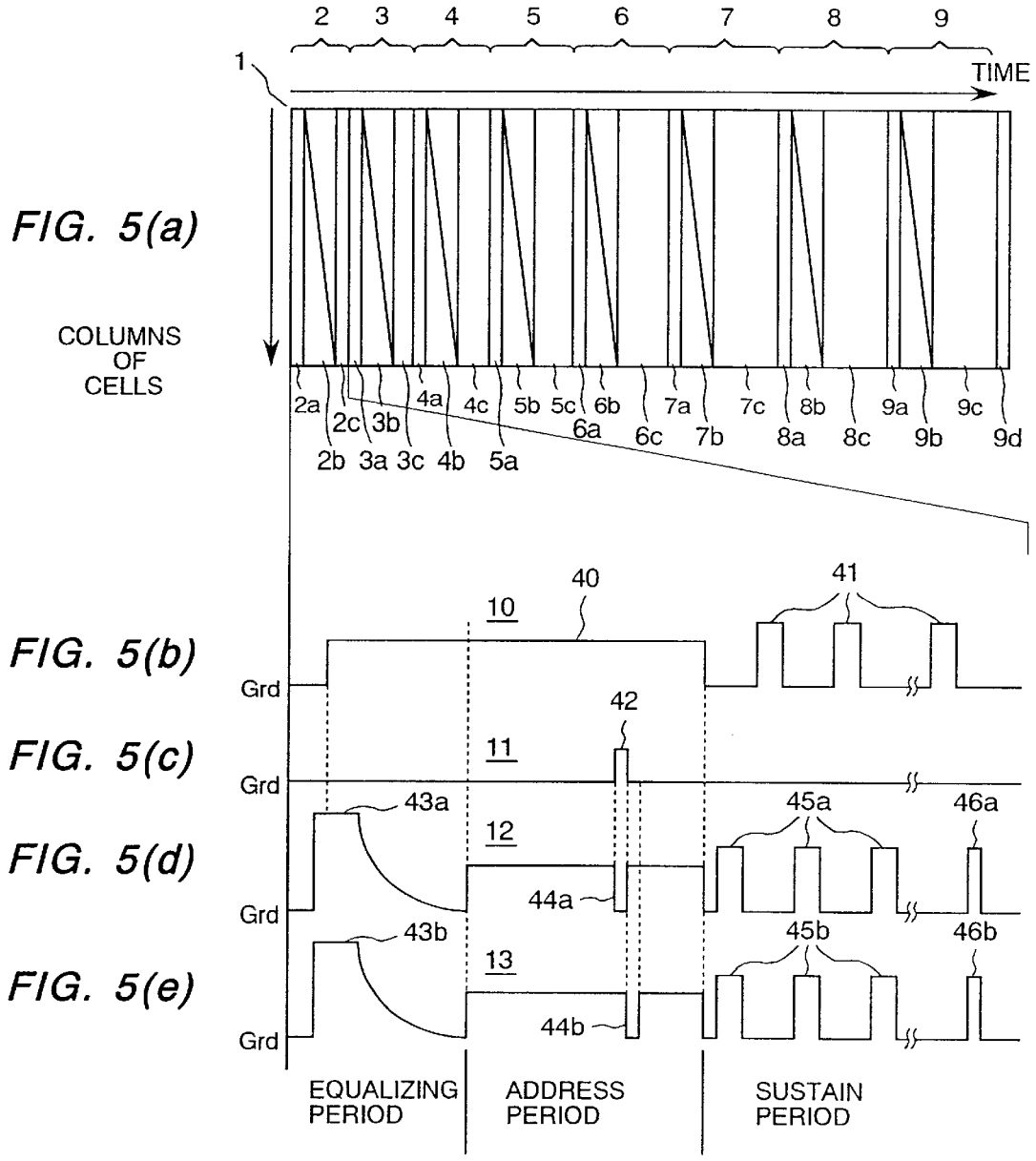
FIG. 5(*a*) is a time chart illustrating an arrangement of sub-fields in one field in accordance with the first embodiment of the present invention.

FIG. 5 illustrates a first driving system in accordance with a first embodiment of the present invention. FIG.(*a*) is a time chart illustrating an arrangement of sub-fields in one field in accordance with the invention. In the figure, reference numeral 1 denotes one field, a horizontal axis illustrates time and a vertical axis illustrates a line of the cell. The one field is divided into eight sub-fields, that is, a first sub-field 2 to a eighth sub-field 9. A electric charge particle equalizing period 2*a*–9*a*, an address period 2*b*–9*b* and a sustaining period 2*c*–9*c* are arranged in order in each sub-field. Numbers of electric discharges are allotted for each sub-field and display gradations are determined by the total numbers of the discharges. The order for arranging the sub-fields having predetermined numbers of discharges is free, but in the embodiment, the sub-fields are arranged in order from a sub-field having a fewer numbers of electric discharge.

FIG. 5(*a*)–FIG. 5(*e*) illustrate wave-forms of pulses supplied to the common X electrode, the address A electrode, and the first and the second independent Y electrode respectively. In the figure, a pulse waveform illustrates a part of driving wave-form supplied to the common X electrode 22 in one field. A pulse wave-form 11 illustrates a part of driving wave-form supplied to the one of the address A electric rode 29. Pulse wave-forms 12 and 13 illustrate a parts of driving wave-form supplied, for example, to a first and a second independent Y electrodes 23.

The pulse wave-form 10 which is supplied to the common X electrode 22 during first sub-field includes a regulating pulse 40 lasting from the electric charge particle equalizing period 2*a* to the address period 2*b* and the sustaining pulses 41 in the sustaining period 2*c*. In this embodiment, the voltage of the regulating pulse 40 is lower than the voltage of the sustaining pulses 41. The pulse wave-form 11 which is supplied to one of the address A electrodes 29 illustrates the address pulse 42 in the address period 2*b* and the address pulse 42 corresponds to the cell to be emitted light. The address pulse 42 is not supplied when there is no cell to be emitted. That is, the address pulses 42 are supplied to the cells to be emitted, and the address pulse 42 is not supplied to the other cells not to be emitted. The pulse wave-forms 12 and 13 which are supplied to the first electrode of the independent Y electrodes 23 and adjacent second electrode of the independent Y electrodes 23 includes a electric charge particle equalizing pulses 43*a*, 43*b*, - - - in the electric charge particle equalizing period 2*a* of the first subfield, scan pulses 44*a*, 44*b*, - - - in the address period 2*b*, sustaining pulses 45*a*, 45*b*, - - - and fine line erasing pulses 46*a*, 46*b*, - - - in the sustaining period 2*c*. In the embodiment, the voltage of the scan pulses 44*a*, 44*b*, - - - is lower than the voltage of the sustaining pulses 45*a*, 45*b*, - - - . The fine line erasing pulses 46*a*, 46*b*, - - - and the equalizing pulses 43*a*, 43*b*, - - - are supplied to the same electrodes. Further, it is preferable to select the pulse width of the fine line erasing pulses 46*a*, 46*b*, - - - between 0.5 μsec-2 μsec.

The movements of the panel is explained hereinafter. In FIG. 5, electric discharges in all cells are performed between the independent Y electrodes 23 and the common X electrodes 22 by supplying the equalizing pulses 43*a*, 43*b*, - - - to the independent Y electrodes 23, and negative electric charge particles are formed on the dielectric layer 26 in the vicinity of the independent Y electrode 23 during electric charge particle equalizing period 2*a* occurring immediately after the power is supplied to the display. The electric discharge by the equalizing pulses 43*a*, 43*b*, - - - occurs only first one time, and the discharge is not occurred after this. That is, the discharge occurs only one time other than the space 33 of the cell becomes abnormal condition. The regulating pulse 40 is supplied to the common X electrode 22 within the time between 0.3 μsec-2 μsec from the rising edge of the equalizing pulses 43*a*, 43*b*, - - - . The negative electric charge particles are formed in the vicinity of the common X electrode 22, and the positive electric charge particles are formed in the vicinity of the address A electrode 29.

The reason the time between the rising edge of the equalizing pulses 43*a*, 43*b*, - - - and the rising edge of the regulating pulse 40 is determined as described the above is that: too many negative electric charge particles are gathered in the vicinity of the independent Y electrode 23 and the negative electric charge particles gather in the common X electrode 22 when the time between edges of both pulses 43*a*, 43*b*, - - - and 40 is selected too long. When the time is too short, the negative electric charge particles are not gathered on the independent Y electrode 23 and also the positive electric charge particles are not gathered on the address A electrode 22.

The main purpose for supplying the regulating pulse 40 is to attract the negative electric charge particles toward the common X electrode 22 and to form the positive electric charge particles on the address A electrode 29. Another purpose is to assist electric discharges between the common X electrode 22 and the independent Y electrode 23 when the address electric discharge is performed between the address A electrode 29 and the independent Y electrode 23.

The address electric discharges is performed in the cell which is formed at the cross point of the first line of the independent Y electrode 23 and one of the address A electrode 22 when the scan pulses 44*a* is supplied to the first line of the independent Y electrode 23 and the address pulse 42 is supplied to one of the address A electrode 29 at the same time, as a result, the positive electric charge particles are gathered on the independent Y electrode 23. On the other hand, no discharge is occurred when the address pulse 42 which corresponds to the scan pulses 44*b* is not supplied to the second line of the independent Y electrode 23, therefore, no electric charge particle is gathered on the independent Y electrode 23. The address pulses 42 are supplied to the address A electrodes 29 which correspond to the cell to be emitted and are selected all the cells at the cross points of all address A electrodes 29 and the scan pulses 44*a* or 44*b* is supplied to the independent Y electrodes 23, so that the electric discharges are performed between the address A electrode 29 and the independent Y electrodes 23.

Next, in the sustaining period 2*c*, the electric discharges for light emitting are performed by the sustaining pulses 41, 45*a*, 45*b*, - - - between the common X electrode 22 and the independent Y electrodes 23 in the cell in which the positive electric charge particles are gathered on the independent Y electrodes 23 side by the electric discharges performed during address period 2*b*. After that, electric discharges occur between the independent Y electrodes 23 and the common X electrode 22 by supplying the fine line erasing pulses 46*a*, 46*b*, - - - to the independent Y electrodes 23 and the electric charge particles in the cells are erased, so that the all electric charge particles generated for light emitting in the cell are erased. The pulse width of the fine line erasing pulses 46*a*, 46*b*, - - - is a little longer than the electric discharge continuation time, therefore, the negative electric charge particles are gathered on the dielectric layer in the vicinity of the independent Y electrodes 23. In the cells in which no electric discharge is occurred, the erasing discharges are not performed because no electric charge particle is in the cell. Therefore, the negative electric charge particles formed in the vicinity of the independent Y electrodes 23 are kept unchanged.

In this situation, no electric discharge occurs by supplying the equalizing pulses 43*a*, 43*b*, - - - to the independent Y electrodes 23 because the negative electric charge particles in the cell negate the voltage of the equalizing pulses 43*a*, 43*b*, - - - and sufficient electric fields needed for electric discharge are not formed. After that, no electric discharge is performed through all sub - - - fields even if the equalizing pulses are supplied. Therefore, the electric discharges are not performed except the first sub-field immediately after the power on, therefore no light emitting occurs in black display.

Further, for the linearity of display gradations determined by the numbers of sustaining pulses, one electric discharge have less influence more than two electric discharges. According to the present invention, the equalization of electric charge particles is effected by one electric discharge in the cell in which the sustaining electric discharge is performed, therefore, the influence to the linearity for display gradations is very small.

The same driving system is performed during the second sub-field 3 to the eighth sub-field 9 and a screen of one field is formed.

FIG. 6–FIG. 10 are sectional views of the plasma display panel in which the condition of electric charge particles in the cell performed sustaining electric discharge are illustrated from the first sub-field after the power is supplied to the second sub-field until the equalizing pulses and the regulating pulse are supplied. In these figure, reference numeral 60 denotes a positive electric charge particles, reference numeral 61 denotes a negative electric charge particles. Further the condition of electric charge particles is illustrated in a cell at center position of FIG. 6–FIG. 7.

Figure 6:
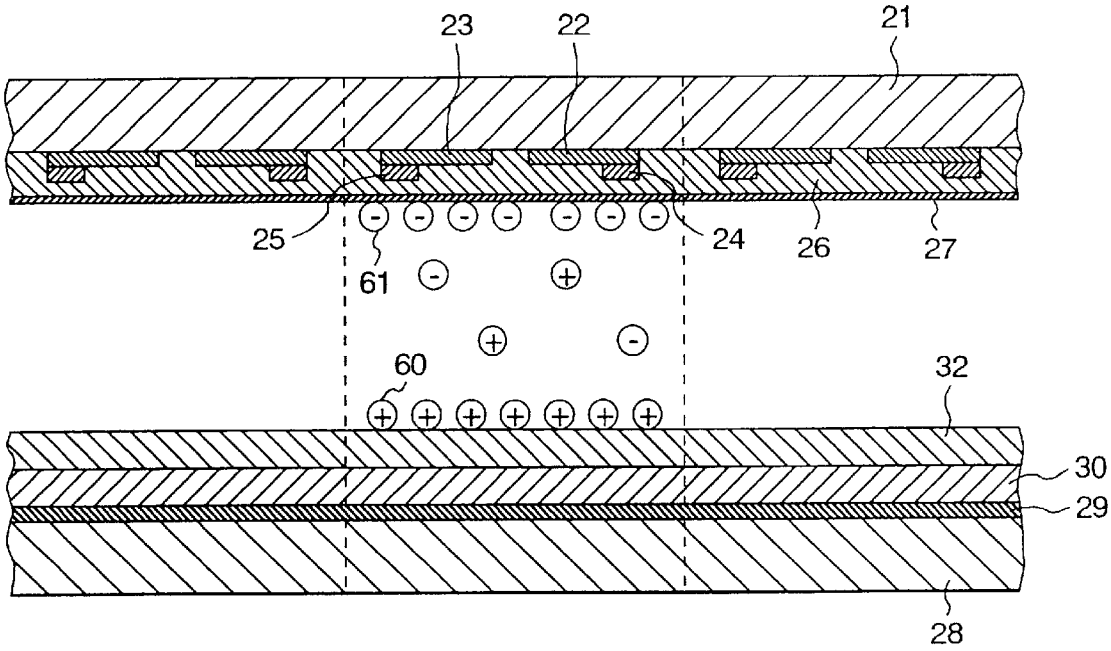
FIG. 6 is a sectional view of a plasma display panel in which a condition of electric charge particles in a cell is illustrated immediately after a power is supplied and then a equalizing pulse and a protecting pulse are supplied.

FIG. 6 is a sectional view of a plasma display panel in which a condition of electric charge particles in a cell is illustrated immediately after a power is supplied and then a equalizing pulse and a regulating pulse are supplied. The figure illustrate the condition of electric charge particles in the first sub-field after power is supplied at first and then the equalizing pulses 43*a*, 43*b* are supplied to the independent Y electrodes 23 and finally the regulating pulse 40 is supplied. The electric discharges in all cells occur between the common X electrode 22 and the independent Y electrodes 23 by supplying the equalizing pulses 43*a*, 43*b*, - - - to the independent Y electrodes 23, and the negative electric charge particles 61 are gathered on the dielectric layer in the vicinity of the independent Y electrodes 23*a* and the common X electrode 22 and the positive electric charge particles 60 are gathered on the address A electrodes 29 side.

Figure 7:
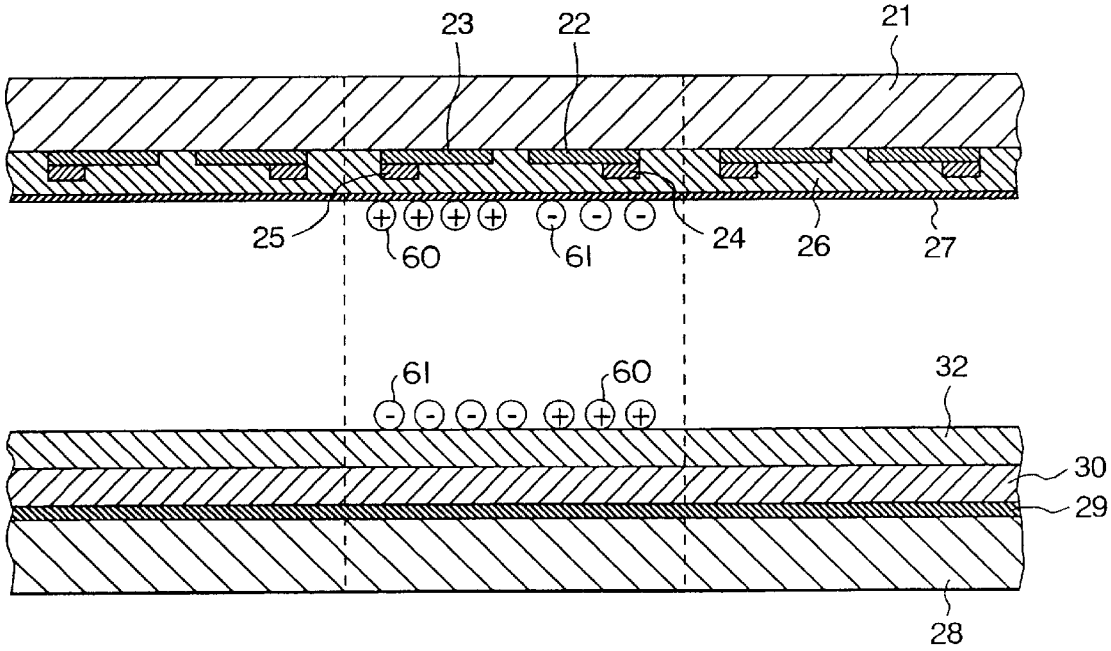
FIG. 7 is a sectional view of a plasma display panel in which a condition of electric charge particles in a cell after performing an address electric discharge is illustrated.

FIG. 7 is a sectional view of a plasma display panel in which a condition of electric charge particles in a cell after performing an address electric discharge is illustrated. In FIG. 7, the condition of electric discharges is illustrated after the address pulses 42 is supplied to the address A electrodes 29 and address electric discharges occur between the address A electrode 29 and the independent Y electrode 23. The positive electric charge particles 60 are gathered on the dielectric layer in the vicinity of the independent Y electrode 23 because the voltage of the independent Y electrode 23 is lower than the voltages of the address A electrode 29 and the common X electrode 22. The condition of the electric charge particles are shown in FIG. 7. The electric discharge occurs between the independent Y electrode 23 and the common X electrode 22 by the positive electric charge particles 60 and the first pulse of the sustaining pulses 45*a*, 45*b*, - - - supplied to the independent Y electrode 23. This is a sustain discharge. This time, the negative electric charge particles 61 are gathered around the independent Y electrode 23 and the positive charges 62 are gathered around the common X electrode 22 by the electric discharge generated by the sustaining pulses 45*a*, 45*b*. As a result, the sustaining electric discharges occur between the independent Y electrode 23 and the common X electrode 22 by the first pulse of sustaining pulses 41. This electric discharges are repeated during sustaining period 2*c*.

Figure 8:
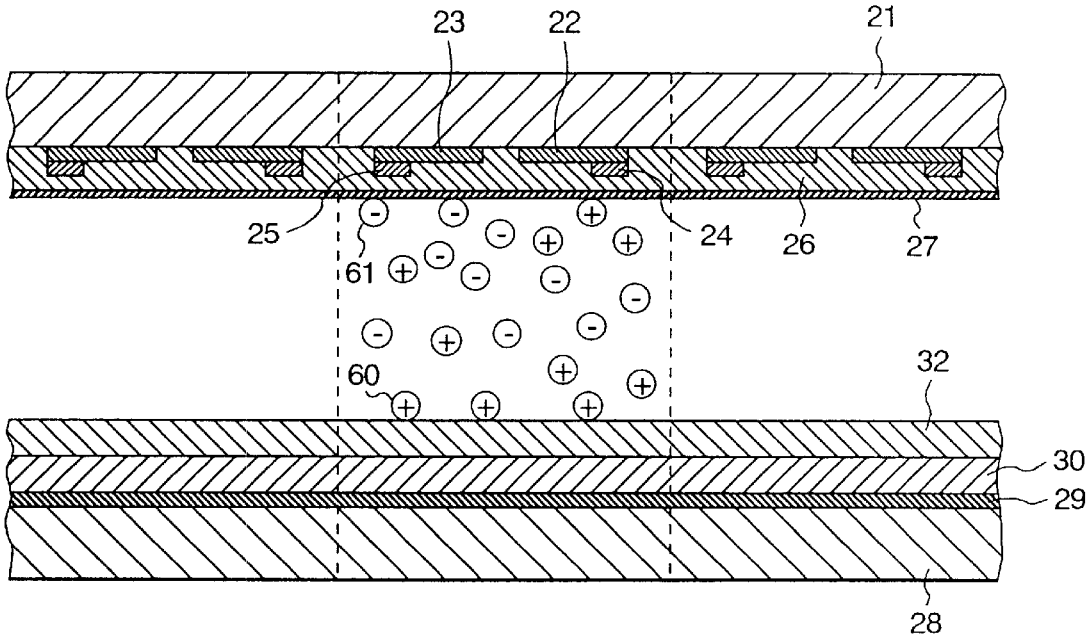
FIG. 8 is a sectional view of a plasma display panel in which a condition of electric charge particles in a cell after supplying a fine line erasing pulse is illustrated.

FIG. 8 is a sectional view of a plasma display panel in which a condition of electric charge particles in a cell after supplying a fine erase pulse is illustrated. In FIG. 8, the condition of electric discharge after the last sustaining pulses 41 is supplied to the common X electrode 22 and then the fine line erasing pulses 46*a*, 46*b*, - - - are supplied is illustrated.

The condition of the electric charge particles after the discharges are occurred by the final sustaining pulses 41 is the same with the condition shown in FIG. 7.

The pulse width of the fine line erasing pulses 46*a*, 46*b*, - - - is longer than the discharge continuation time, so that negative electric charge particles 61 which move so quickly are gathered on the dielectric layer in the vicinity of the independent Y electrode 23. As a result, separation of the electric charge particles is performed. The positive electric charge particles that move slowly in space float in the cell. The negative charges float discharge space for a while.

Figure 9:
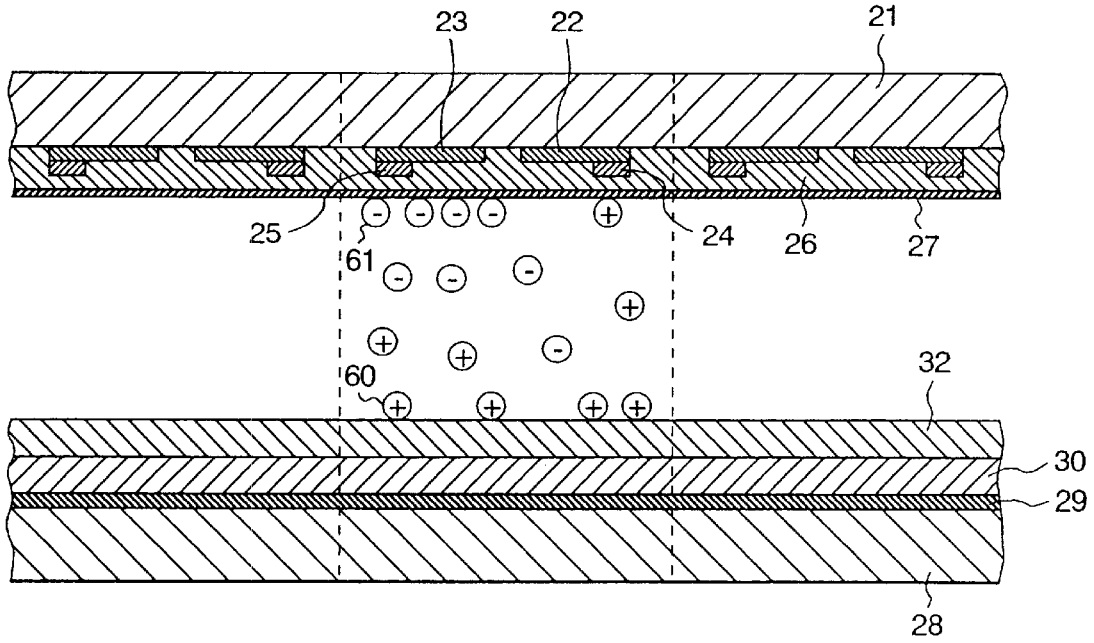
FIG. 9 is a sectional view of a plasma display panel in which a condition of electric charge particles in a cell after supplying a equalizing pulse in a second field is illustrated.

FIG. 9 is a sectional view of a plasma display panel in which a condition of electric charge particles in a cell after supplying a equalizing pulse in a second field is illustrated. In FIG. 9, a condition of electric discharge after the equalizing pulses 43*a*, 43*b*, - - - in the second sub-field are supplied is illustrated. The voltage of the equalizing pulses 43*a*, 43*b*, - - - are canceled by the negative charges and is not reached to the discharge voltage, so that any discharges is not performed. The voltage of the independent Y electrode 23 is higher than the voltage of the other electrodes, so the negative charges are attracted towered the independent Y electrode 23.

Figure 10:
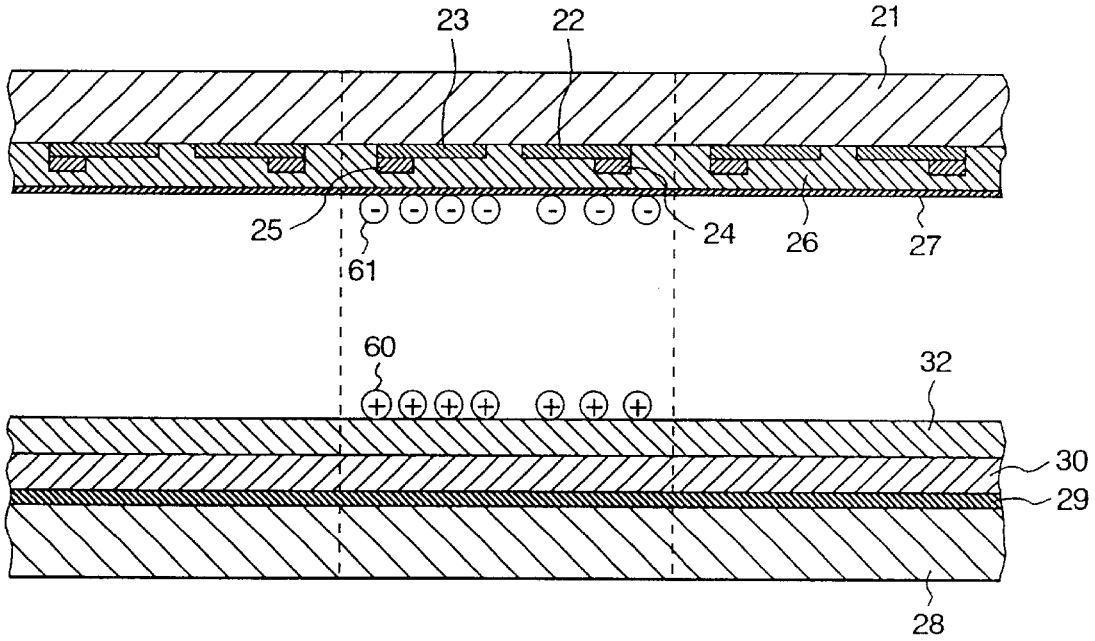
FIG. 10 is a sectional view of a plasma display panel in which a condition of electric charge particles in a cell after supplying a regulating pulse in a second field is illustrated.

FIG. 10 is a sectional view of a plasma display panel in which a condition of electric charge particles in a cell after supplying a regulating pulse in a second field is illustrated.

Referring to the drawing, the condition of electric charge particles after the regulating pulse 40 is supplied to the common X electrode 22 is illustrated. The negative electric charge particles are gathered on the dielectric layer in the vicinity of the common X electrode 22 and the positive charges are gathered at the address A electrode 29. By this, the same driving as the first sub-field is performed without electric discharge by the equalizing pulses 43*a*, 43*b*, - - - . In this case, the voltage of the equalizing pulses 43*a*, 43*b*, - - - is reduced by the negative electric charge particles at the independent Y electrode 23, so that the electric discharge between the independent Y electrode 23 and the common X electrode 22 is not performed.

The driving of the panel is capable of performing without using the full writing electric discharge and fine line erasing electric discharge for each sub-field. As a result, unnecessary light emitting is erased for displaying black brightness so that the contrast is improved.

Figures 11A, 11B, 11C, 11D, 11E:
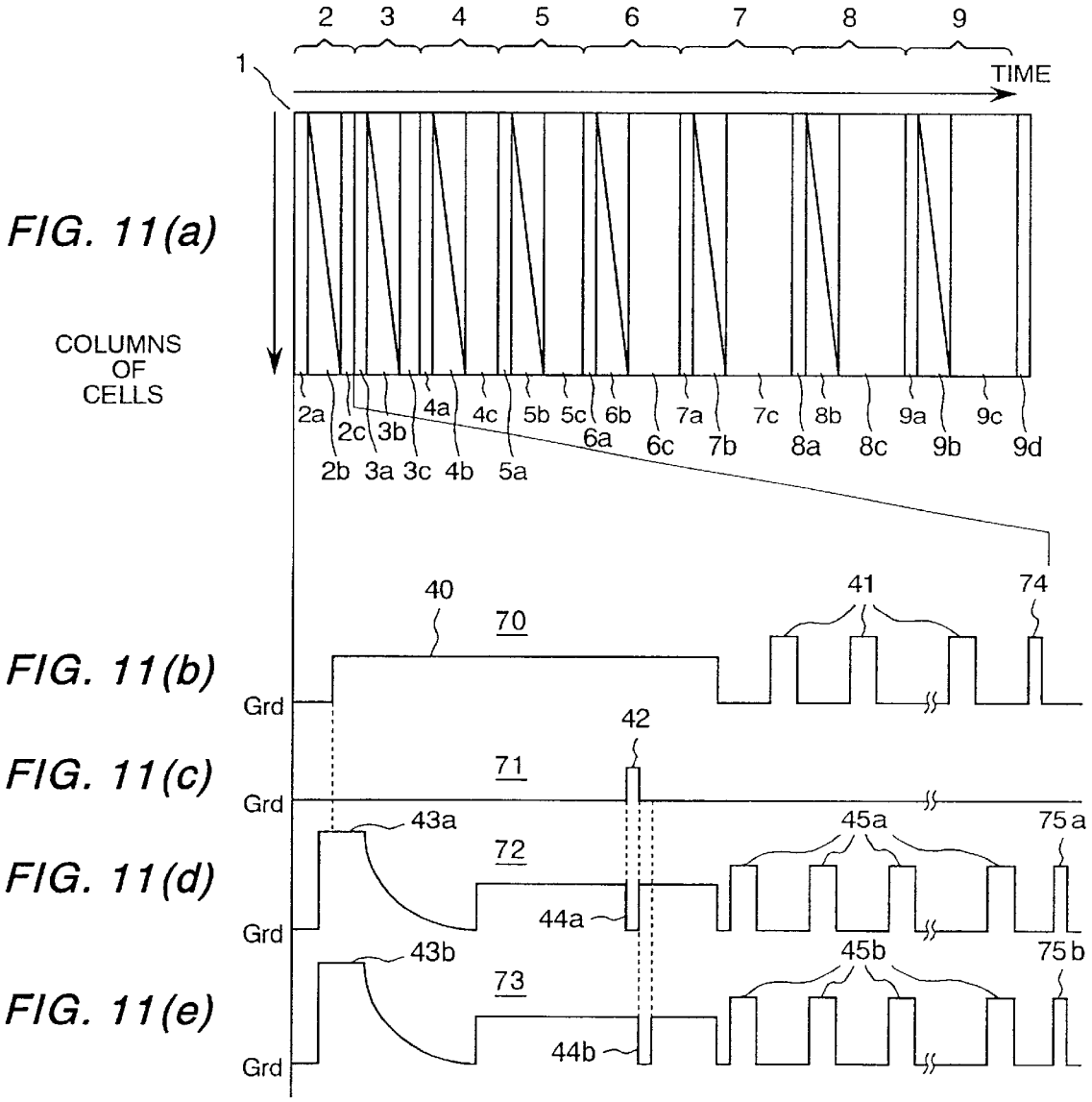
FIG. 11(*a*) is a time chart illustrating an arrangement of sub-fields in one field in accordance with the present invention.

The second embodiment of the present invention is described hereinafter. FIG. 11 illustrates a second driving system in accordance with a second embodiment of the present invention. FIG.(*a*) is a time chart illustrating an arrangement of sub-fields in one field in accordance with the present invention. The figure illustrates a division of one field into several sub-fields such as the case of FIG. 5. A horizontal axis shows time and a vertical axis shows lines of cells.

FIG. 11(*b*)–FIG. 11(*e*) illustrate wave-forms of pulses supplied to the common X electrode, the address A electrode, and the first and the second independent Y electrode respectively.

A pulse wave-form 70 illustrates a part of driving wave-form supplied to the common X electrode 22 in one field. A pulse wave-form 71 illustrates a part of driving wave-form supplied to the one of the address A electrode 29. Pulse wave-forms 72 and 73 illustrate parts of driving wave-form supplied, for example, to a first and a second independent Y electrodes 23.

The pulse wave-form 70 which is supplied to the common X electrode 22 during first sub-field includes a regulating pulse 40 lasting from the electric charge particle equalizing period 2*a* to the address period 2*b* and the sustaining pulses 41 and a fine line erasing pulse 74 in the sustaining period 2*c*. The pulse wave-form 71 which is supplied to one of the address A electrodes 29 illustrates the address pulse 42 in the address period 2*b* which corresponds to the light emitting cell. The address pulses 42 is not supplied when there is no cell to be emitted. The pulse wave-forms 71 and 72 which are supplied to the first electrode of the independent Y electrodes 23 and adjacent second electrode of the independent Y electrodes 23 includes a electric charge particle equalizing pulse 43*a* 43*b*, - - - in the electric charge particle equalizing period 2*a* of the first sub-field, scan pulse 44*a*, 44*b*, - - - in the address period 2*b*, sustaining pulses 45*a*, 45*b*, - - - and a first fine line erasing pulses 75*a*, 75*b*, - - - in the sustaining period 2*c*.

Under these circumstances, the pulse width of the first fine line erasing pulses 75*a*, 75*b*, - - - is the same with or shorter than a pulse width of a second fine line erasing pulse 74. The number of the fine line erasing pulses is an even number as shown in FIG. 11, that is, the first and the second fine line erasing pulses 75*a*, 75*b* and 74, the first fine line erasing pulses 75*a*, 75*b*, - - - which are the last erasing pulses and the equalizing pulses 43*a*, 43*b*, - - - are supplied to the same electrodes, that is, the independent Y electrode 23 of FIG. 11. The second fine line erasing pulse 74 is supplied to the other electrode, that is, the common X electrode 22.

In the embodiment, the last sustaining pulse is supplied to the independent Y electrode 23. A condition of electric charge particles after supplying the first fine line erasing pulses 75*a*, 75*b*, - - - is almost same as the condition shown in FIG. 8. in accordance with the first embodiment. The condition of electric discharges in the other sub-fields 3–9 are the same condition. Further, the erasing and polarizing of electric charge particles are performed by these fine line erasing pulses, so these erasing pulses are called polarization pulse group. In this embodiment, by using the first and the second fine line erasing pulses 75*a*, 75*b* and 74, the erasing and polarization are effectively performed, and electric discharging time during address discharging time is maintained constant.

Figures 12A, 12B, 12C, 12D, 12E:
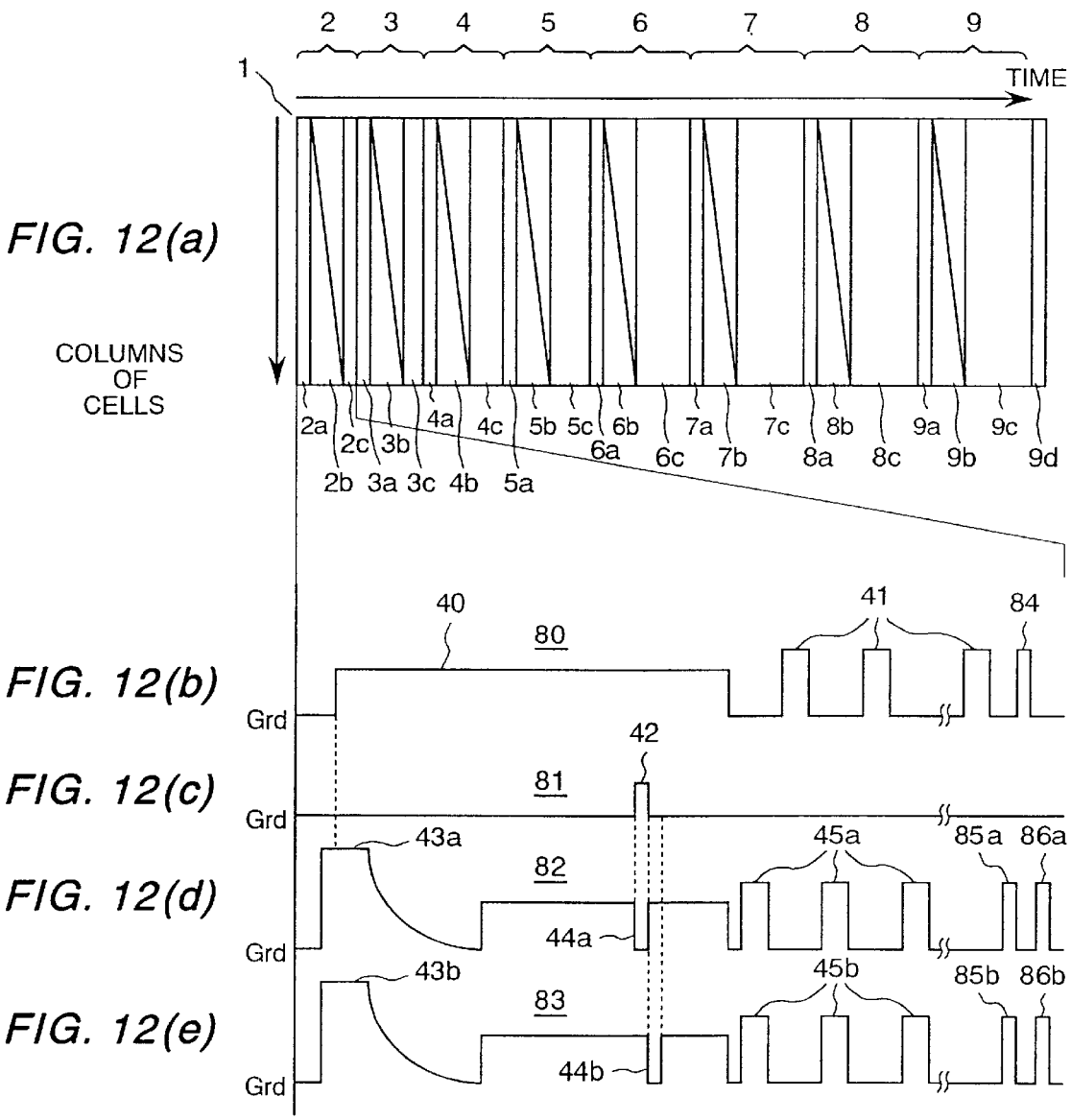
FIG. 12(*a*) is a time chart illustrating an arrangement of sub-fields in one field in accordance with the present invention.

The third embodiment of the present invention is described hereinafter. FIG. 12 illustrates a third driving system in accordance with a third embodiment of the present invention. FIG. 12(*a*) is a time chart illustrating an arrangement of sub-fields in one field in accordance with the present invention. The Figure illustrates a division of one field into several sub-fields such as the case of FIG. 5. A horizontal axis illustrates time and a vertical axis illustrates line of cells.

FIG. 12(*b*)–FIG. 12(*e*) illustrate wave-forms of pulses supplied to the common X electrode, the address A electrode, and the first and the second independent Y electrode respectively.

A pulse wave-form 80 illustrates a part of driving wave-form supplied to the common X electrode 22 in first sub-field. A pulse wave-form 81 illustrates a part of driving wave-form supplied to the one of the address A electrode 29. Pulse wave-forms 82 and 83 illustrate parts of driving wave-forms supplied, for example, to a first and a second independent Y electrodes 23.

The pulse wave-form 80 which is supplied to the common X electrode 22 during the first sub-field includes a regulating pulse 40 lasting from the electric charge particle equalizing period 2*a* to the address period 2*b* and the sustaining pulses 41 in the sustaining period 2*c* and second fine line erasing pulse 84. The pulse wave-form 81 which is supplied to one of the address A electrodes 29 illustrates the address pulse 42 in the address period 2*b* which corresponds to the light emitting cell. The address pulses 42 is not supplied when there is no cell to be emitted. The pulse wave-forms 82 and 83 which are supplied to the first electrode of the independent Y electrodes 23 and adjacent second electrode of the independent Y electrodes 23 includes electric charge particles equalizing pulse 43*a* 43*b*, - - - in the electric charge particles equalizing period 2*a* of the first sub-field, scan pulses 44*a*, 44*b*, - - - in the address period 2*b*, sustaining pulses 45*a*, 45*b*, - - - and a third fine line erasing pulses 85*a*, 85*b*, - - - and a first fine line erasing pulses 86*a*, 86*b*, - - - in the sustaining period 2*c*.

Under these circumstances, the pulse width of the second fine line erasing pulses 84 is the same as or shorter than a pulse width of a third fine line erasing pulses 85*a*, 85*b*, - - - .

And a pulse width of the first fine line erasing pulses 86*a*, 86*b*, - - - is the same as or shorter than a pulse width of the second fine line erasing pulse 84

If the numbers of the fine line erasing pulses are an odd number as shown in FIG. 12, that is, the first to the third fine line erasing pulses, the first fine line erasing pulses 86*a*, 86*b*, - - - which are the last supplied erasing pulses and the equalizing pulses 43*a*, 43*b*, - - - are supplied to the same electrodes, that is, the independent Y electrode 23 of FIG. 12. The third fine line erasing pulse 85 which is first supplied fine line erasing pulse is supplied to the same electrode to which first supplied fine line erasing pulses 86*a* and 86*b* are supplied, that is, the independent Y electrode 23. Therefore, the last sustaining pulse is supplied to the common X electrode 22. A condition of electric charge particles after supplying the first fine line erasing pulses 86*a*, 86*b*, - - - is almost same condition as shown in FIG. 8 in accordance with the first embodiment. The condition of electric discharges in the other sub-fields 3-9 is the same condition. In the embodiment, by using the first, the second and the third fine line erasing pulses 86*a*, 86*b*, 84, 85*a* and 85*b*, the erasing and polarization are more effectively performed, and electric discharging time during address discharging time is maintained constant. According to an experiment by present inventors, it is effective for erasing up to three fine line erasing pulses and using more than four fine line erasing pulses is not so effective.

Figures 13A, 13B, 13C, 13D, 13E:
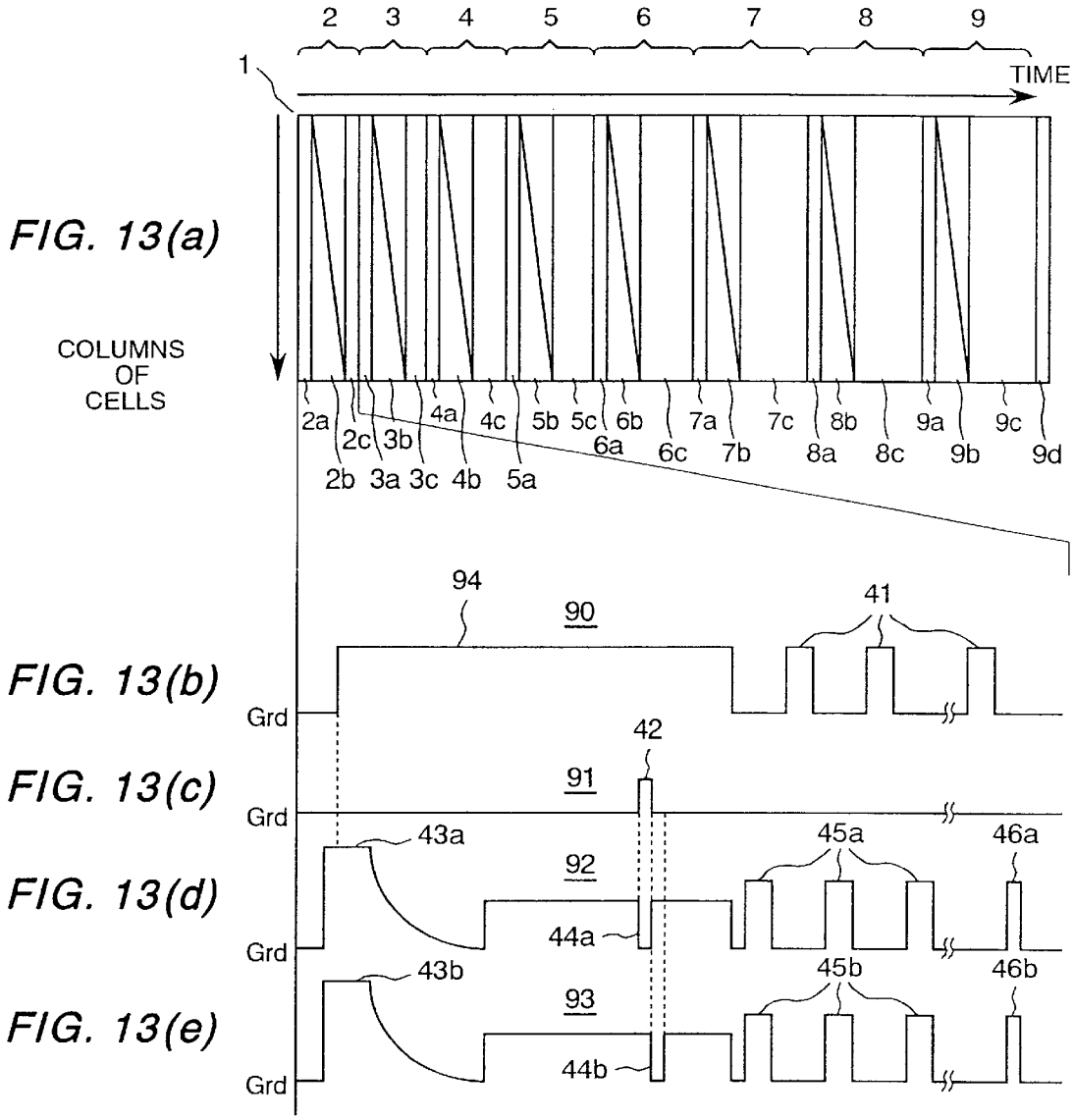
FIG. 13(*a*) is a time chart illustrating an arrangement of sub-fields in one field in accordance with the invention.

The fourth embodiment of the present invention is described hereinafter. FIG. 13 illustrates a fourth driving system in accordance with a fourth embodiment of the present invention. FIG. 13(*a*) is a time chart illustrating an arrangement of sub-fields in one field in accordance with the present invention. The figure illustrates a division of one field into several sub-fields such as the case of FIG. 5. A horizontal axis illustrates time and a vertical axis illustrates line of cells.

FIG. 13(*b*)–FIG. 13(*e*) illustrate wave-forms of pulses supplied to the common X electrode, the address A electrode, and the first and the second independent Y electrode respectively.

A pulse wave-form 90 illustrates a part of driving wave-form supplied to the common X electrode 22 in the first sub-field. A pulse wave-form 91 illustrates a part of driving wave-form supplied to the one of the address A electrode 29. Pulse wave-forms 92 and 93 illustrate parts of driving wave-forms supplied, for example, to a first and a second independent Y electrodes 23.

The pulse wave-form 90 which is supplied to the common X electrode 22 during the first sub-field includes a regulating pulse 94 lasting from the electric charge particles equalizing period 2*a* to the address period 2*b* and the sustaining pulses 41 in the sustaining period 2*c*.

The voltage of the regulating pulse 94 and the voltage of the sustaining pulses 41 are the same, thereby a driving circuit is simplified because the same power is used. The pulse wave-form 91 which is supplied to one of the address A electrodes 29 illustrates the address pulses 42 in the address period 2*b* which corresponds to the light emitting cell. The address pulses 42 is not supplied when there is no cell to be emitted. The pulse wave-forms 92 and 93 which are supplied to the first wave-forms 92 and 93 which are supplied to the first electrode of the independent Y electrodes 23 and adjacent second electrode of the independent Y electrodes 23 includes a electric charge particle equalizing pulse 43*a* 43*b*, - - - in the electric charge particle equalizing period 2*a* of the first sub-field, scan pulse 44*a*, 44*b*, - - - in the address period 2*b*, sustaining pulses 45*a*, 45*b*, - - - and fine line erasing pulses 46*a*, 46*b*, - - - in the sustaining period 2*c*. A condition of electric charge particles after supplying the fine line erasing pulses 46*a*, 46*b*, - - - is almost same condition as shown in FIG. 8 which illustrates the condition of electric charge particles in accordance with the first embodiment. The condition of electric discharge in the other sub-fields 3–9 is the same condition. In the embodiment, the voltage of the regulating pulse 94 supplied to the common X electrode 22 and the voltage of the sustaining pulses are the same, therefore simplifying the driving circuit construction.

Figures 14A, 14B, 14C, 14D, 14E:
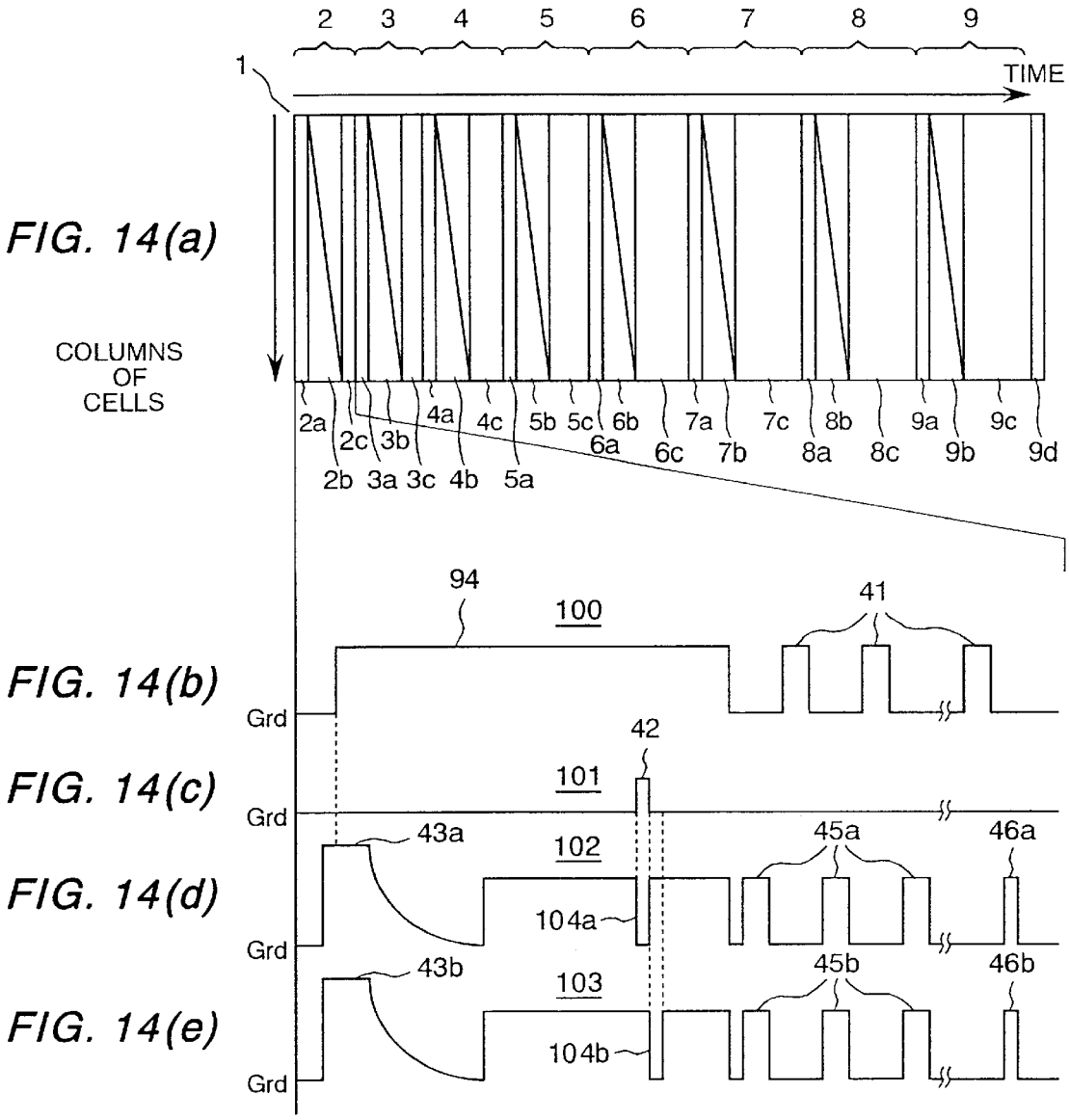
FIG. 14(*a*) is a time chart illustrating an arrangement of sub-fields in one field in accordance with the invention.

The fifth embodiment of the present invention is described hereinafter. FIG. 14 illustrates a fifth driving system in accordance with a fifth embodiment of the present invention. FIG. 14(*a*) is a time chart illustrating an arrangement of sub-fields in one field in accordance with the present invention. The figure illustrates a division of one field into several subfields such as the case of FIG. 5. A horizontal axis illustrates time and a vertical axis illustrates line of cells. FIG. 14(*b*)–FIG. 14(*e*) illustrate wave-forms of pulses supplied to the common X electrode, the address A electrode, and the first and the second independent Y electrode respectively.

A pulse wave-form 100 illustrates a part of driving wave-form supplied to the common X electrode 22 in the first sub-field. A pulse wave-form 101 illustrates a part of driving wave-form supplied to the one of the address A electrode 29. Pulse wave-forms 102 and 103 illustrate parts of driving wave-forms supplied, for example, to a first and a second independent Y electrodes 23.

The pulse wave-form 100 which is supplied to the common X electrode 22 during the first sub-field includes a regulating pulse 94 lasting from the electric charge particle equalizing period 2*a* to the address period 2*b* and the sustaining pulses 41 in the sustaining period 2*c*. The voltage of the regulating pulse 94 and the voltage of the sustaining pulses 41 are the same as the fourth embodiment shown in FIG. 13, thereby a driving circuit is simplified because the same power is used. The pulse wave-form 101 which is supplied to one of the address A electrodes 29 illustrates the address pulses 42 in the address period 2*b* which corresponds to the light emitting cell. The address pulses 42 is not supplied when there is no cell to be emitted. The pulse wave-forms 102 and 103 which are supplied to the first electrode of the independent Y electrodes 23 and adjacent second electrode of the independent Y electrodes 23 includes electric charge particles equalizing pulse 43*a* 43*b*, - - - in the electric charge particle equalizing period 2*a* of the first sub-field, scan pulses 104*a*, 104*b*, - - - in the address period 2*b*, sustaining pulses 45*a*, 45*b*, - - - and fine line erasing pulses 46*a*, 46*b*, - - - in the sustaining period 2*c*. The voltage of the independent Y electrode 23 during the address period 2*c* and the voltage of the sustaining pulses 45*a*, 45*b*, - - - are the same, thereby a driving circuit is simplified because the same power is used. A condition of electric charge particles after supplying the fine line erasing pulses 46*a*, 46*b*, - - - is almost same condition as shown in FIG. 8 which illustrates the condition of electric charge particles in accordance with the first embodiment. The condition of electric charge particles in the other sub-fields 3–9 is the same the condition.

Figures 15A, 15B, 15C, 15D, 15E:
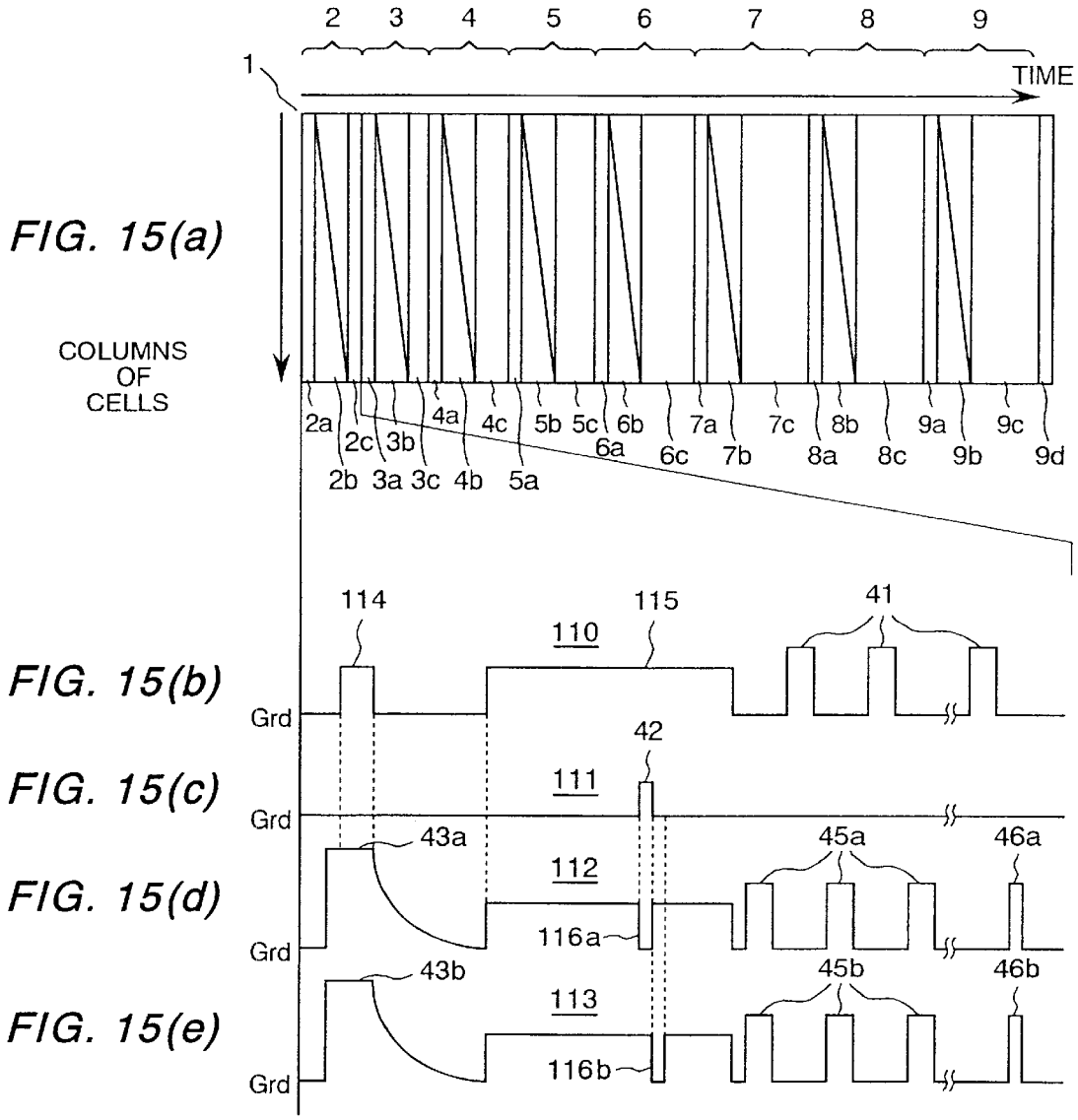
FIG. 15(*a*) is a time chart illustrating an arrangement of sub-fields in one field in accordance with the present invention.

The sixth embodiment of the present invention is described hereinafter. FIG. 15 illustrates a sixth driving system in accordance with a fifth embodiment of the present invention. FIG. 15(*a*) is a time chart illustrating an arrangement of sub-fields in one field in accordance with the present invention. The figure illustrates a division of one field into several sub-fields such as the case of FIG. 5. A horizontal axis illustrates time and a vertical axis illustrates line of cells. FIG. 15(*b*)–FIG. 15(*e*) illustrate wave-forms of pulses supplied to the common X electrode, the address A electrode, and the first and the second independent Y electrode respectively.

A pulse wave-form 110 illustrates a part of driving wave-form supplied to the common X electrode 22 in the first sub-field. A pulse wave-form 111 illustrates a part of driving wave-form supplied to the one of the address A electrode 29. Pulse wave-forms 112 and 113 illustrate parts of driving wave-forms supplied, for example, to a first and a second independent Y electrodes 23.

The pulse wave-form 111 which is supplied to the common X electrode 22 during the first sub-field includes a first regulating pulse 114 in the electric charge particle equalizing period 2*a*, a second regulating pulse 115 in the address period 2*b* and the sustaining pulses 41 in the sustaining period 2*c*. In the embodiment, the regulating pulse supplied to the common X electrode 22 is divided into the first regulating pulse 114 in the electric charge particle equalizing period 2*a* and the second regulation pulse 115 in the address period 2*b*. The pulse wave-form 111 which is supplied to one of the address A electrodes 29 includes the address pulses 42 in the address period 2*b* which corresponds to the light emitting cell. The address pulses 42 is not supplied when there is no cell to be emitted. The pulse wave-forms 112 and 113 which are supplied to the first electrode of the independent Y electrodes 23 and adjacent second electrode of the independent Y electrodes 23 includes a electric charge particle equalizing pulses 43*a* 43*b*, - - - in the electric charge particle equalizing period 2*a* of the first sub-field, a scan pulse 114*a*, 114*b*, - - - in the address period 2*b*, sustaining pulses 45*a*, 45*b*, - - - and fine line erasing pulses 46*a*, 46*b*, - - - in the sustaining period 2*c*. A condition of electric charge particles after supplying the fine line erasing pulses 46*a*, 46*b*, - - - is almost same condition as shown in FIG. 8 which illustrates the condition of electric charge particles in accordance with the first embodiment. The condition of electric discharge in the other sub-fields 3–9 is the same condition. In FIG. 15, the falling edge of the first regulating pulse is slightly earlier than that of the equalizing pulse 43*a*, thereby preventing electric discharging by mistake between the common X electrode 22 and the independent Y electrode. Further, a rising edge of the second regulating pulse and a rising edge of the scan pulses 115 is effected at the same time, thereby preventing electric discharge by mistake between the common X electrode 22 and the independent Y electrode 23.

The first regulating pulse 114 supplied to the common X electrode 22 and the sustaining pulses 41 may use the same voltage.

Figures 16A, 16B, 16C, 16D, 16E:
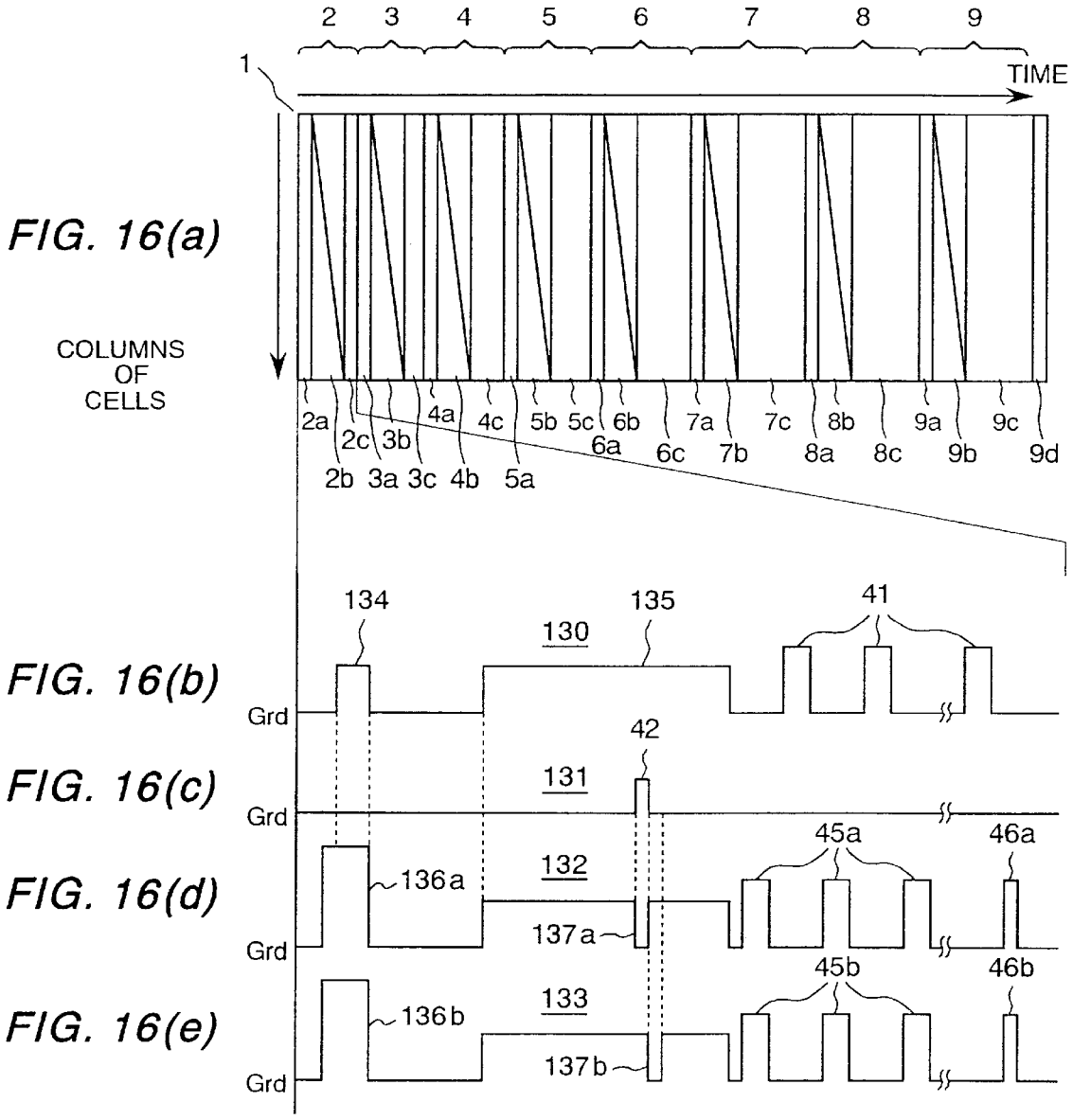
FIG. 16(*a*) is a time chart illustrating an arrangement of sub-fields in one field in accordance with the invention.

The seventh embodiment of the present invention is described hereinafter. FIG. 16 illustrates a seventh driving system in accordance with a seventh embodiment of the present invention. FIG. 16(*a*) is a time chart illustrating an arrangement of sub-fields in one field in accordance with the present invention. The figure illustrates a division of one field into several sub-fields such as the case of FIG. 5. A horizontal axis illustrates time and a vertical axis illustrates line of cells. FIG. 16(*b*)–FIG. 16(*e*) illustrate wave-forms of pulses supplied to the common X electrode, the address A electrode, and the first and the second independent Y electrode respectively.

A pulse wave-form 130 illustrates a part of driving wave-form supplied to the common X electrode 22 in the first sub-field. A pulse wave-form 131 illustrates a part of driving wave-form supplied to the one of the address A electrode 29. Pulse wave-forms 132 and 133 illustrate parts of driving wave-forms supplied, for example, to a first and a second independent Y electrodes 23.

The pulse wave-form 131 which is supplied to the common X electrode 22 during the first sub-field includes a first regulating pulse 134 in the electric charge particle equalizing period 2*a*, a second regulating pulse 135 in the address period 2*b* and the sustaining pulses 41 in the sustaining period 2*c*. The pulse wave-form 131 which is supplied to one of the address A electrodes 29 includes the address pulses 42 in the address period 2*b* of the first sub-field which corresponds to the light emitting cell. The address pulses 42 is not supplied when there is no cell to be emitted. The pulse wave-forms 132 and 133 which are supplied to the first electrode of the independent Y electrodes 23 and adjacent second electrode of the independent Y electrodes 23 includes a electric charge particle equalizing pulse 136*a* 136*b*, - - - in the electric charge particle equalizing period 2*a* of the first sub-field, a scan pulse 137*a*, 137*b*, - - - in the address period 2*b*, sustaining pulses 45*a*, 45*b*, - - - and fine line erasing pulses 46*a*, 46*b*, - - - in the sustaining period 2*c*.

A falling edge of the equalizing pulse 136*a*, 136*b*, - - - becomes zero voltage within the time less than 1 $\mu$s in accordance with the present embodiment which is different from above mentioned embodiment. As the voltage of the second regulating pulse 135 and the scan pulses 137*a*, 137*b*, the same voltage of the sustaining pulses 41, 45*a*, 45*b*, - - - is able to apply. A condition of electric charge particles after supplying the fine line erasing pulses 46*a*, 46*b*, - - - is almost same condition as shown in FIG. 8 which illustrates the condition of electric charge particles in accordance with the first embodiment. The condition of electric discharge in the other sub-fields 3-9 is the same condition.

In the embodiment, the edge of the first regulating pulse 139 falls before the edge of the equalizing pulse falls as shown in FIG. 16, thereby preventing electric discharge by mistake between the common X electrode 22 and the independent Y electrode.

Figures 17A, 17B, 17C, 17D, 17E:
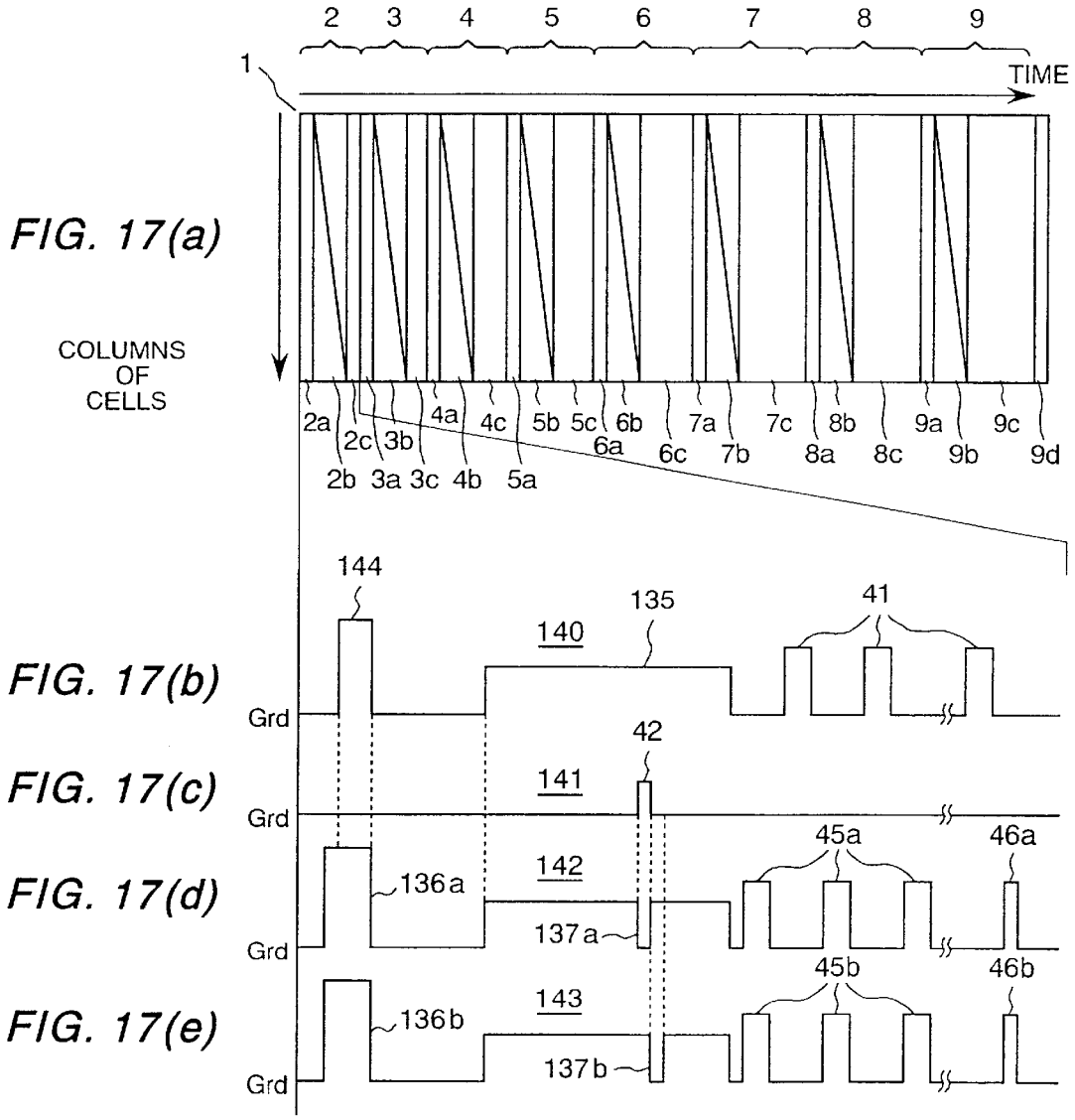
FIG. 17(*a*) is a time chart illustrating an arrangement of sub-fields in one field in accordance with the present invention.

The eighth embodiment of the present invention is described hereinafter. FIG. 17 illustrates a eighth driving system in accordance with a eighth embodiment of the present invention. FIG. 17(*a*) is a time chart illustrating an arrangement of sub-fields in one field in accordance with the present invention. The figure illustrates a division of one field into several sub-fields such as the case of FIG. 5. A horizontal axis illustrates time and a vertical axis illustrates line of cells. FIG. 17(*b*)–FIG. 17(*e*) illustrate wave-forms of pulses supplied to the common X electrode, the address A electrode, and the first and the second independent Y electrode respectively.

A pulse wave-form 140 illustrates a part of driving wave-form supplied to the common X electrode 22 in the first sub-field. A pulse wave-form 141 illustrates a part of driving wave-form supplied to the one of the address A electrode 29. Pulse wave-forms 142 and 143 illustrate part of driving wave-form supplied, for example, to a first and a second independent Y electrodes 23.

The pulse wave-form 141 which is supplied to the common X electrode 22 during the first sub-field includes a first regulating pulse 144 in the electric charge particle equalizing period 2*a*, a second regulating pulse 145 in the address period 2*b* and the sustaining pulses 41 in the sustaining period 2*c*.

According to the present embodiment, the voltage of the first regulating pulse 144 is set higher than the voltage of the sustaining pulses 41. The pulse wave-form 141 which is supplied to one of the address A electrodes 29 includes the address pulses 42 in the address period 2*b* of the first sub-field which corresponds to the light emitting cell. The address pulses 42 is not supplied when there is no cell to be emitted. The pulse wave-forms 142 and 143 which are supplied to the first electrode of the independent Y electrodes 23 and adjacent second electrode of the independent Y electrodes 23 includes a electric charge particle equalizing pulse 136*a* 136*b*, - - - in the electric charge particle equalizing period 2*a* of the first sub-field, a scan pulse 137*a*, 137*b*, - - - in the address period 2*b*, a sustaining pulses 45*a*, 45*b*, - - - and fine line erasing pulses 46*a*, 46*b*, - - - in the sustaining period 2*c*.

The voltage of the second regulating pulse 144 and the scan pulses 137*a*, 137*b*, - - - can be set the same voltage of the sustaining pulses 41, 45*a*, 45*b*, - - - . A condition of electric charge particles after supplying the fine line erasing pulses 46*a*, 46*b*, - - - is almost same condition as shown in FIG. 8 which illustrates the condition of electric charge particles in accordance with the first embodiment. The condition of electric discharge in the other sub-fields 3–9 is the same with the condition.

According to the present embodiment, the voltage of the first regulating pulse 144 is higher than that of the sustaining pulses 41. By using higher voltage of the first regulating pulse 144, a lot of negative electric charge particles can be collected, and as a result, a lot of positive electric charge particles are collected on the address electrode 29 side, thereby address discharging is performed so easily.

Figures 18A, 18B, 18C, 18D, 18E:
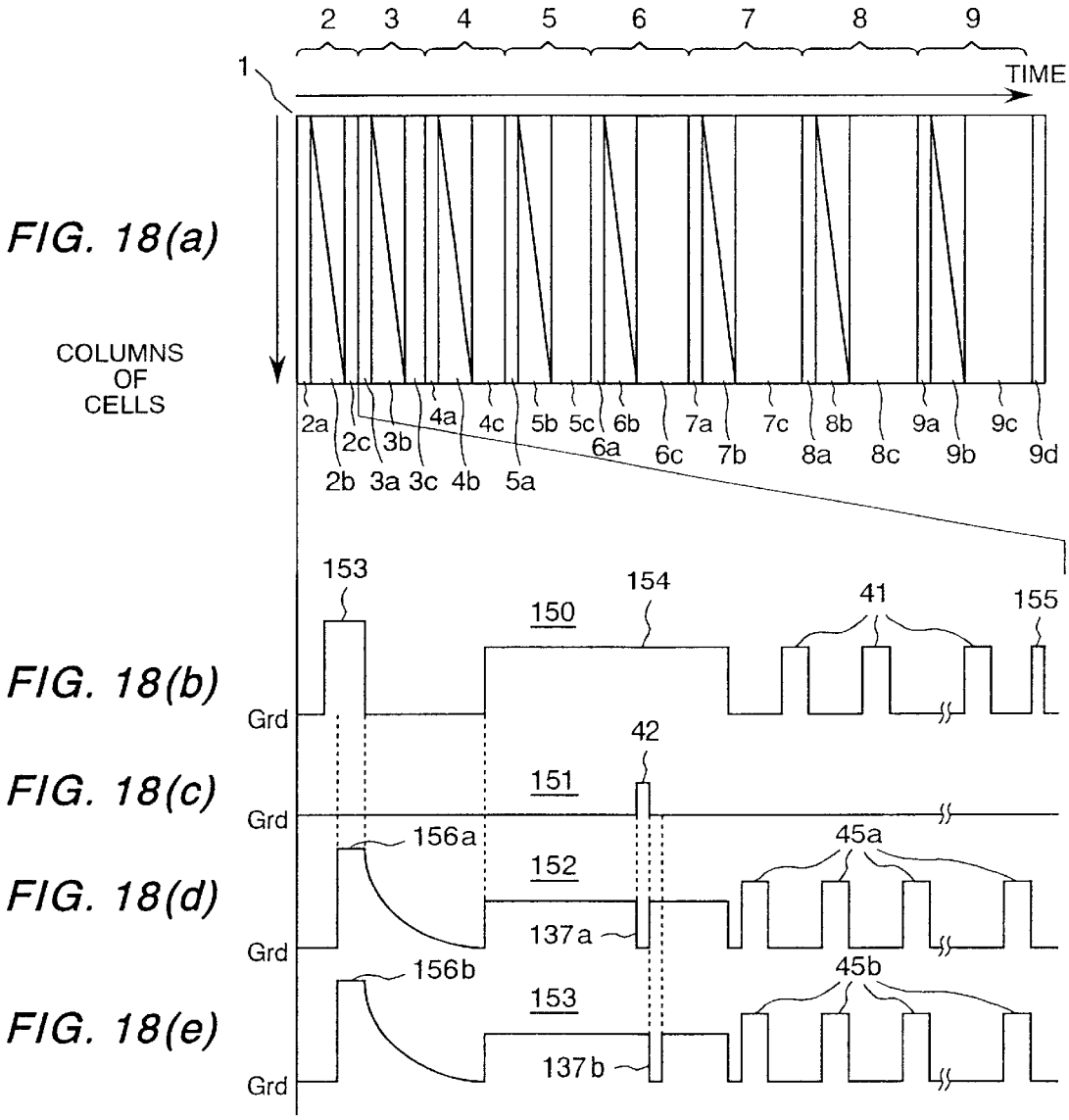
FIG. 18(*a*) is a time chart illustrating an arrangement of sub-fields in one field in accordance with the present invention.

The ninth embodiment of the present invention is described hereinafter. FIG. 18 illustrates a ninth driving system in accordance with a ninth embodiment of the present invention. FIG. 18(*a*) is a time chart illustrating an arrangement of sub-fields in one field in accordance with the present invention. The figure illustrates a division of one field into several subfields such as the case of FIG. 5. A horizontal axis illustrates time and a vertical axis illustrates line of cells. FIG. 18(*b*)–FIG. 18(*e*) illustrate wave-forms of pulses supplied to the common X electrode, the address A electrode, and the first and the second independent Y electrode respectively.

A pulse wave-form 150 illustrates a part of driving wave-form supplied to the common X electrode 22 in the first sub-field. A pulse wave-form 151 illustrates a part of driving wave-form supplied to the one of the address A electrode 29. Pulse wave-forms 152 and 153 illustrate parts of driving wave-forms supplied, for example, to a first and a second independent Y electrodes 23.

The pulse wave-form 151 which is supplied to the common X electrode 22 during the first sub-field includes a equalizing pulse 153 in the electric charge particle equalizing period 2*a*, a second regulating pulse 154 in the address period 2*b* and the sustaining pulses 41 and a fine line erasing pulse 155 in the sustaining period 2*c*.

According to the present embodiment, the only one fine line erasing pulse 155 is provided. The equalizing pulse 153 is supplied to the electrode to which the fine line erasing pulse 155 is supplied such as the case of the fifth embodiment. In case the numbers of the fine line erasing pulses are two or three as shown in the second and the third embodiment (see FIG. 11 and FIG. 12), the equalizing pulses are supplied to the electrode to which the last fine line erasing pulse is supplied.

The pulse wave-form 151 which is supplied to one of the address A electrodes 29 includes the address pulses 42 in the address period 2*b* of the first sub-field which corresponds to the light emitting cell. The address pulses 42 are not supplied when there is no cell to be emitted. The pulse wave-forms 152 and 153 which are supplied to the first electrode of the independent Y electrodes 23 and adjacent second electrode of the independent Y electrodes 23 include a first regulating pulse 156*a*, 156*b*, - - - in the electric charge particle equalizing period 2*a* of the first sub-field, a scan pulse 137*a*, 137*b*, - - - in the address period 2*b*, sustaining pulses 45*a*, 45*b*, - - - in the sustaining period 2*c*.

In the embodiment, the first regulating pulses 156*a*, 156*b*, - - - are supplied within the lapse of time 0.3 μsec to 2 μsec from the rising edge of the equalizing pulse 153.

The voltage of the second regulating pulse 144 and the scan pulses 137*a*, 137*b*, - - - can be set the same voltage of the sustaining pulses 41, 45*a*, 45*b*, - - - as shown in the fifth embodiment (see FIG. 14) A condition of electric charge particles after supplying the fine line erasing pulses 46*a*, 46*b*, - - - is almost same condition as shown in FIG. 8 which illustrates the condition of electric charge particles in accordance with the first embodiment. The condition of electric discharge in the other sub-fields 3–9 is the same with the condition.

According to the present embodiment, the first regulating pulse 43*a*, 43*b*, - - - are similar to the equalizing pulse 43*a*, 43*b*, - - - as shown in FIG. 15, but a equalizing pulse according to the present invention is a pulse that rises first during electric charge particle equalizing period. The reason for providing 0.3 μsec to 2 μsec period between the rising edge of the equalizing pulse 153 and the rising edge of the first regulating pulse 156*a*, 156*b*, - - - has already explained.

From FIG. 19 to FIG. 23 are sectional views of the plasma display panel in accordance with the ninth embodiment in which the condition of electric charge particles in the cell performed electric discharge for light emitting are illustrated from the first sub-field after the power is supplied to the second sub-field until the equalizing pulses and the regulating pulse are supplied. In these drawings, reference numeral 60 denotes a positive electric charge particle, reference numeral 61 denotes a negative electric charge particle. Further the condition of electric charge particles is illustrated in a cell at center position of FIG. 19 through FIG. 23.

Figure 19:
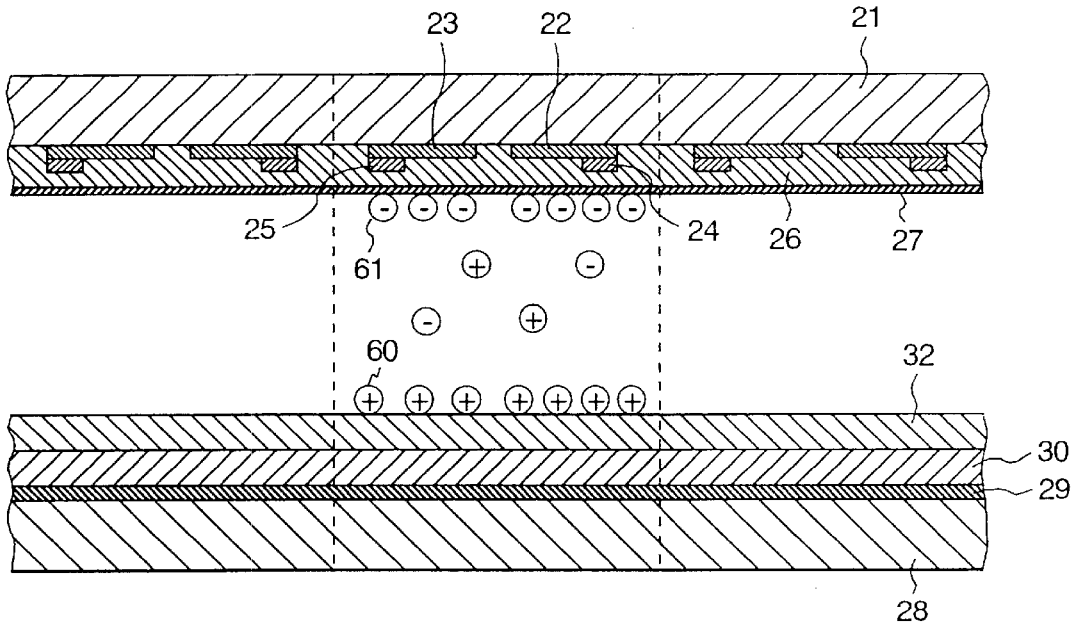
FIG. 19 is a sectional view of a plasma display panel in which a condition of electric charge particles in a cell is illustrated immediately after a power is supplied and then a equalizing pulse and a regulating pulse are supplied in accordance with the ninth embodiment.

FIG. 19 is a sectional view of a plasma display panel in which a condition of electric charge particles in a cell is illustrated immediately after a power is supplied and then a equalizing pulse and a protecting pulse are supplied. The figure illustrate the condition of electric charge particles in first sub-field after power is supplied at first and then the equalizing pulses 153 are supplied to the common X electrode 22 and finally the first regulating pulses 156*a*, 156*b*, - - - are supplied. The electric discharge occurs between the common X electrode 22 and the independent Y electrodes 23 by supplying the equalizing pulses 153 to the independent Y electrodes 23 in all cells, and the negative electric charge particles 61 are gathered on the dielectric layer in the vicinity of the independent Y electrodes 23*a* and the common X electrode 22 and the positive electric charge particles 60 are gathered on the address A electrodes 29 side.

Figure 20:
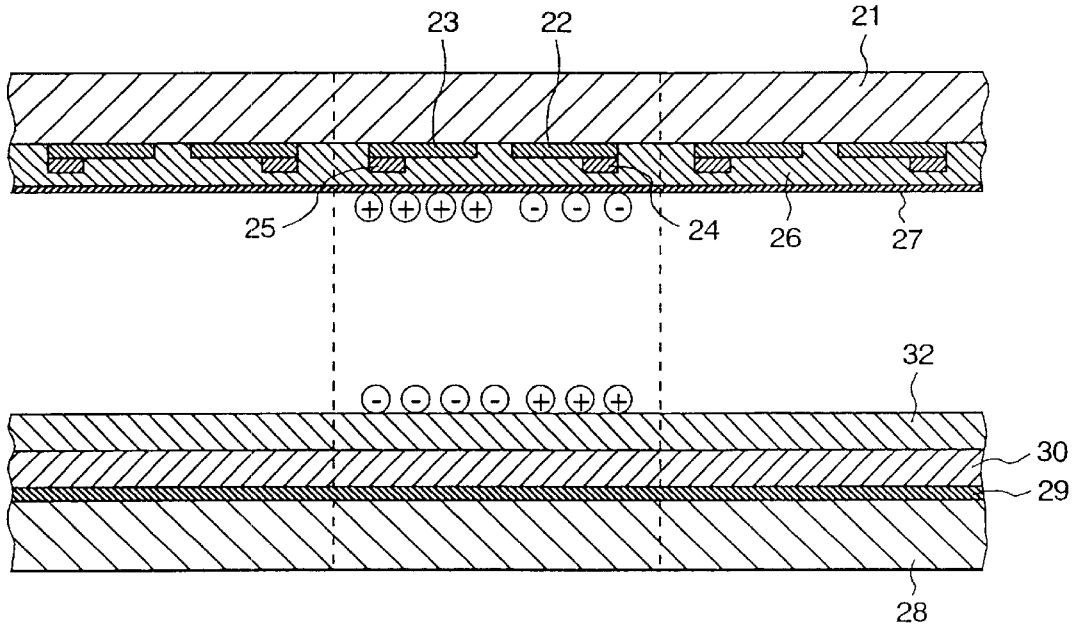
FIG. 20 is a sectional view of a plasma display panel in which a condition of electric charge particles in a cell after performing a address electric discharge is illustrated in accordance with ninth embodiment of the present invention.

FIG. 20 is a sectional view of a plasma display panel in accordance with the ninth embodiment in which a condition of electric charge particles in a cell after performing an address electric discharge is illustrated. In FIG. 20, the condition of electric discharges is illustrated after the address pulses 42 is supplied to the address A electrodes 29 and address electric discharges are performed between the address A electrode 29 and the independent Y electrode 23. The positive electric charge particles 60 are gathered on the dielectric layer in the vicinity of the independent Y electrode 23 because the voltage of the independent Y electrode 23 is lower than the voltages of the address A electrode 29 and the common X electrode 22. The negative electric charge particles 61 are gathered on the other electrode side.

The condition of the electric charge particles is shown in FIG. 20. The sustaining electric discharge occurs between the independent Y electrode 23 and the common X electrode 22 by the positive electric charges particles 60 and the first pulse of the sustaining pulses 45*a*, 45*b*, - - - supplied to the independent Y electrode 23. This is a sustain discharge.

Figure 21:
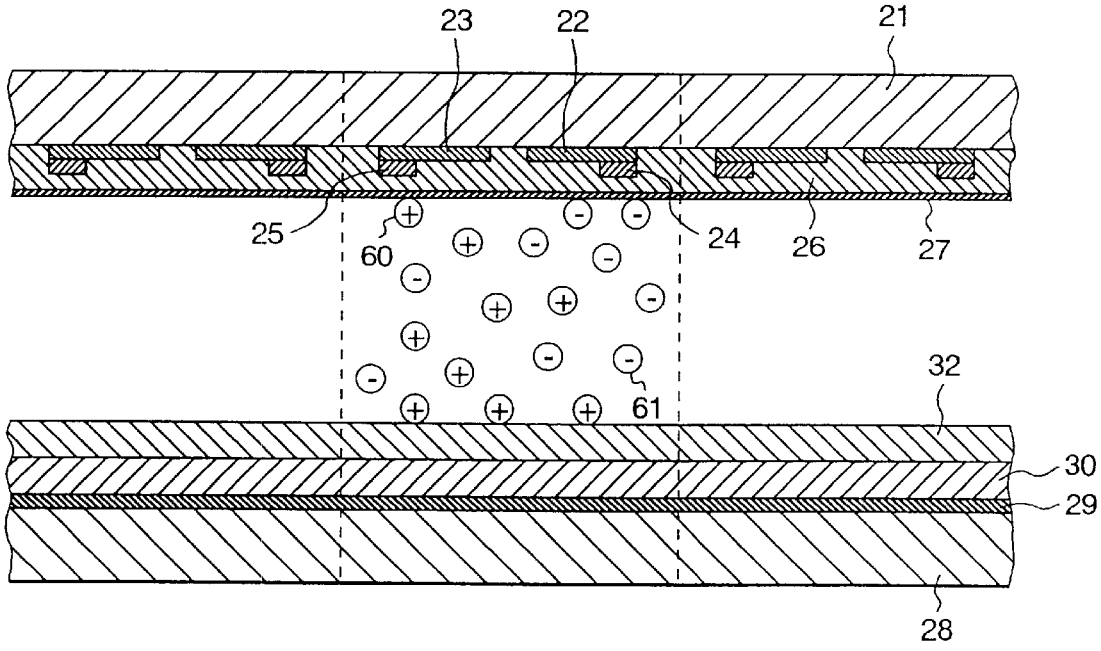
FIG. 21 is a sectional view of a plasma display panel in which a condition of electric charge particles in a cell after supplying a fine line erasing pulse is illustrated in accordance with the ninth embodiment of the present invention.

FIG. 21 is a sectional view of a plasma display panel in which a condition of electric charge particles in a cell after supplying a fine line erasing pulse is illustrated. In FIG. 21, the condition of electric discharge after the last sustaining pulses 45*a*, 45*b*, - - - are supplied to the independent Y electrode and then the fine line erasing pulses 155 are supplied to the common X electrode 22 is illustrated.

The pulse width of the fine line erasing pulse 155 is longer than the discharge continuation time, so that negative electric charges particles 61 which move so quickly are gathered on the dielectric layer in the vicinity of the common X electrode 22. The positive electric charge particles that move slowly in space float in the cell. The negative charges float discharge space for a while.

Figure 22:
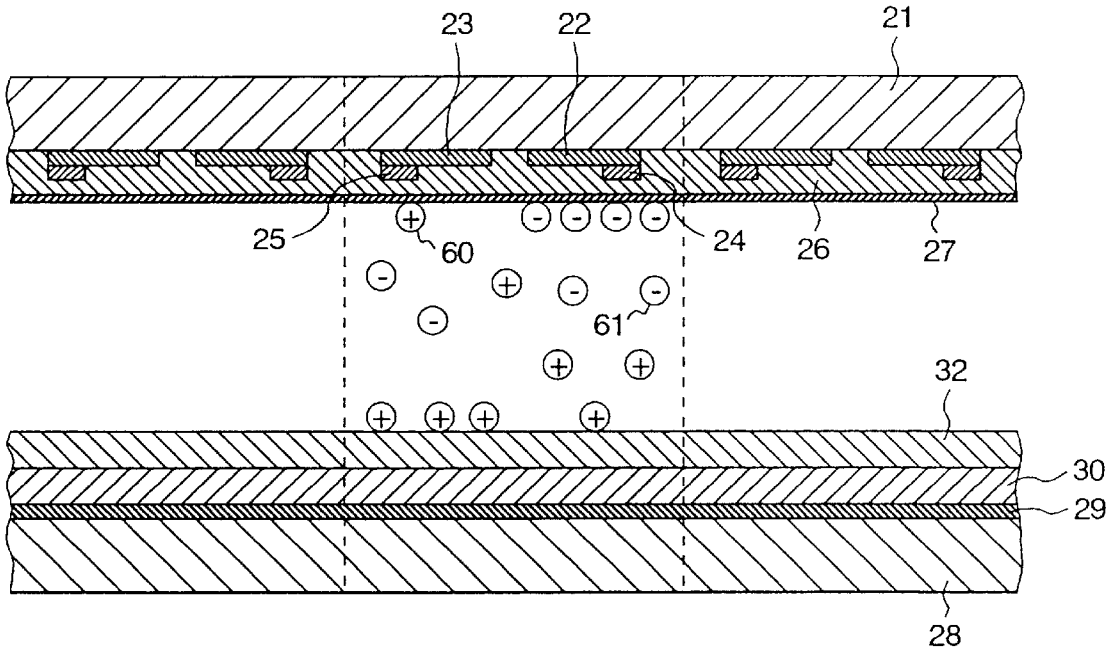
FIG. 22 is a sectional view of a plasma display panel in which a condition of electric charge particles in a cell after supplying a equalizing pulse in a second field is illustrated in accordance with the ninth embodiment of the present invention.

FIG. 22 is a sectional view of a plasma display panel in accordance with the ninth embodiment in which a condition of electric charge particles in a cell after supplying a equalizing pulses in a second field is illustrated.

In FIG. 22, a condition of electric discharge after the equalizing pulse 153 in the second sub-field is supplied is illustrated. The voltage of the equalizing pulse 153 is canceled by the negative charge particles 61 and is not reached to the discharge voltage, so that any electric discharge is not occurred.

Figure 23:
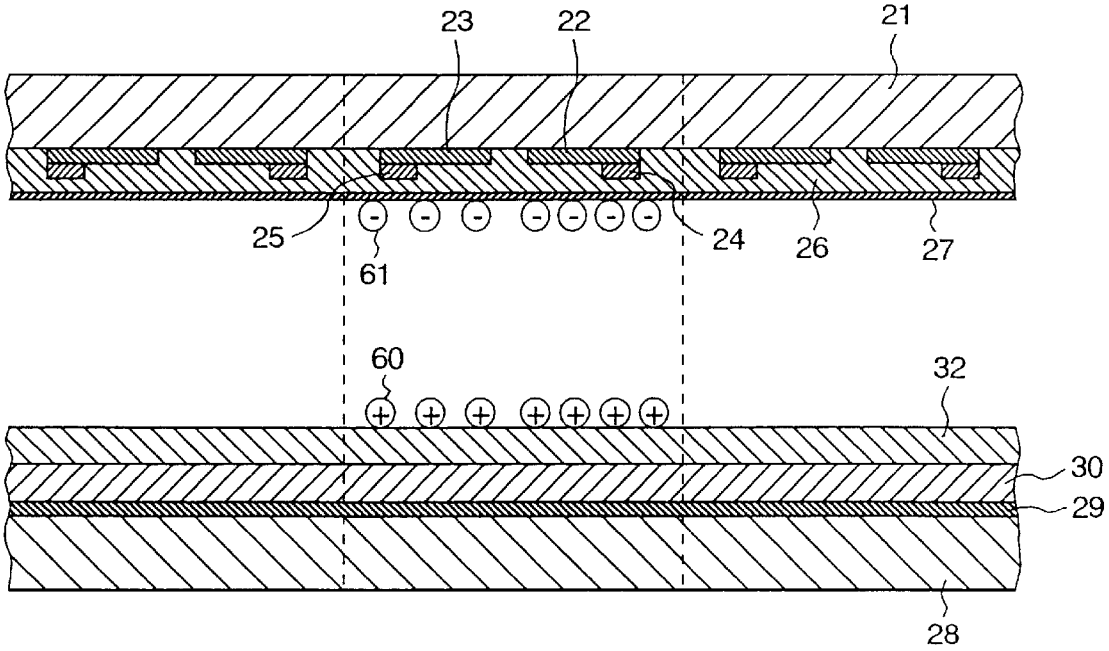
FIG. 23 is a sectional view of a plasma display panel in which a condition of electric charge particles in a cell after supplying a regulating pulse in a second field is illustrated in accordance with the ninth embodiment of the present invention.

FIG. 23 is a sectional view of a plasma display panel in which a condition of electric charges in a cell after supplying a regulating pulse in a second field is illustrated.

In the figure, the condition of electric charge particles after the first regulating pulses 156*a*, 156*b*, - - - are supplied to the independent Y electrode 23 is illustrated. The negative electric charge particles 61 are gathered on the dielectric layer in the vicinity of the common X electrode 22 and the independent Y electrode 23, and the positive electric charge particles 60 are gathered on the address A electrode 29. By this, the same driving as the first sub-field is performed without electric discharge by the equalizing pulses 153.

Figures 24A, 24B, 24C, 24D, 24E:
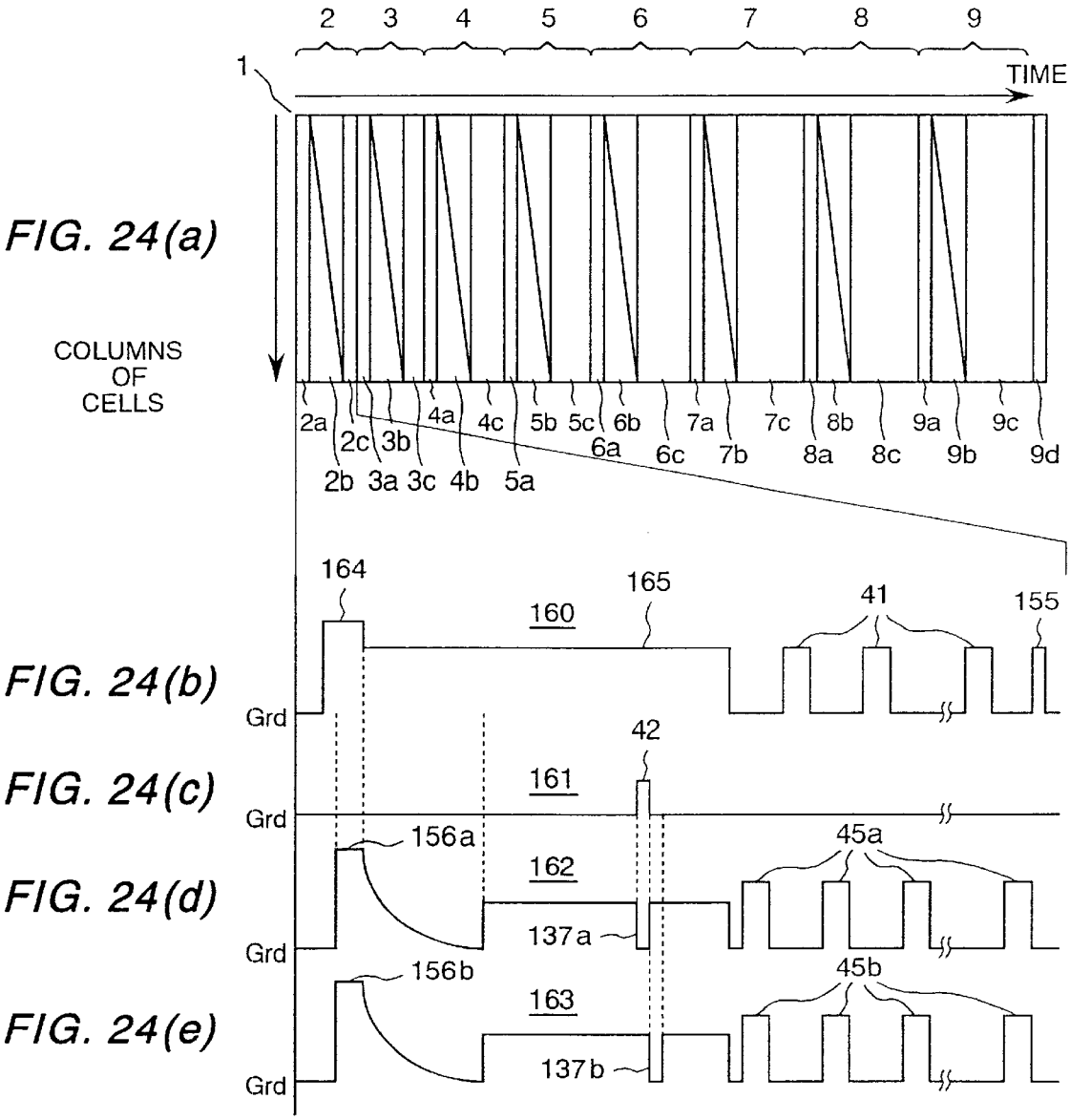
FIG. 24(*a*) is a time chart illustrating an arrangement of sub-fields in one field in accordance with the present invention.

The tenth embodiment of the present invention is described hereinafter. FIG. 24 illustrates a tenth driving system in accordance with a tenth embodiment of the present invention. FIG. 24(*a*) is a time chart illustrating an arrangement of sub-fields in one field in accordance with the present invention. The figure illustrates a division of one field into several sub-fields such as the case of FIG. 18. A horizontal axis illustrates time and a vertical axis illustrates line of cells. FIG. 24(*b*)–FIG. 24(*e*) illustrate wave-forms of pulses supplied to the common X electrode, the address A electrode, and the first and the second independent Y electrode respectively.

A pulse wave-form 160 illustrates a part of driving wave-form supplied to the common X electrode 22 in the first sub-field. A pulse wave-form 161 illustrates a part of driving wave-form supplied to the one of the address A electrode 29. Pulse wave-forms 162 and 163 illustrate parts of driving wave-forms supplied, for example, to a first and a second independent Y electrodes 23.

The pulse wave-form 160 which is supplied to the common X electrode 22 during the first sub-field includes a equalizing pulse 163 in the electric charge particle equalizing period 2*a*, a second regulating pulse 165 which continues from equalizing pulse 164 in the electric charge particle equalizing period 2*a* and the address period 2*b* and the sustaining pulses 41 and a fine line erasing pulse 155 in the sustaining period 2*c*.

According to the present embodiment, the only one fine line erasing pulse is provided. The equalizing pulse 164 is supplied to the electrode to which the fine line erasing pulse 155 is supplied such as the case of the first embodiment. In case the numbers of the fine line erasing pulses are two or three as shown in the second and the third embodiment (see FIG. 11 and FIG. 12), the equalizing pulse is supplied to the electrode to which the last fine line erasing pulse is supplied. The pulse wave-form 161 which is supplied to one of the address A electrodes 29 includes the address pulses 42 in the address period 2*b* of the first sub-field which correspond to the light emitting cell. The address pulses 42 are not supplied when there is no cell to be emitted. The pulse wave-forms 162 and 163 which are supplied to the first electrode of the independent Y electrodes 23 and adjacent second electrode of the independent Y electrodes 23 includes a first regulating pulse 156*a*, 156*b*, - - - in the electric charge particle equalizing period 2*a* of the first sub-field, scan pulses 137*a*, 137*b*, - - - in the address period 2*b*, sustaining pulses 45*a*, 45*b*, - - - in the sustaining period 2*c*. In the embodiment, the first regulating pulses 156*a*, 156*b*, - - - are supplied within the lapse of time 0.3 μsec to 2 μsec from the rising edge of the equalizing pulse 153. The voltage of the second regulating pulse 165 and the scan pulses 137*a*, 137*b*, - - - can be set the same voltage of the sustaining pulses 41, 45*a*, 45*b*, - - - as shown in the ninth embodiment (see FIG. 18). The other sub-fields 3–9 are constructed the same as the first sub-field.

A condition of electric charge particles after supplying the fine line erasing pulses 46*a*, 46*b*, - - - are almost same condition as shown in FIG. 8 which illustrates the condition of electric charge particles in accordance with the first embodiment. The condition of electric discharge in the other sub-fields 3–9 is the same condition.

According to the present embodiment, the reason for setting the voltage of the equalizing pulse 164 a higher voltage is to collect the negative electric charge particles on the common X electrode side, and to collect lots of positive electric charge particles on the address A electrode 29. Further, the reason for setting the voltage of the second regulating pulse 165 in the address period 2*b* is to protect electric discharging by mistake between the common X electrode 22 and the independent Y electrode 23.

Figures 25A, 25B, 25C, 25D, 25E:
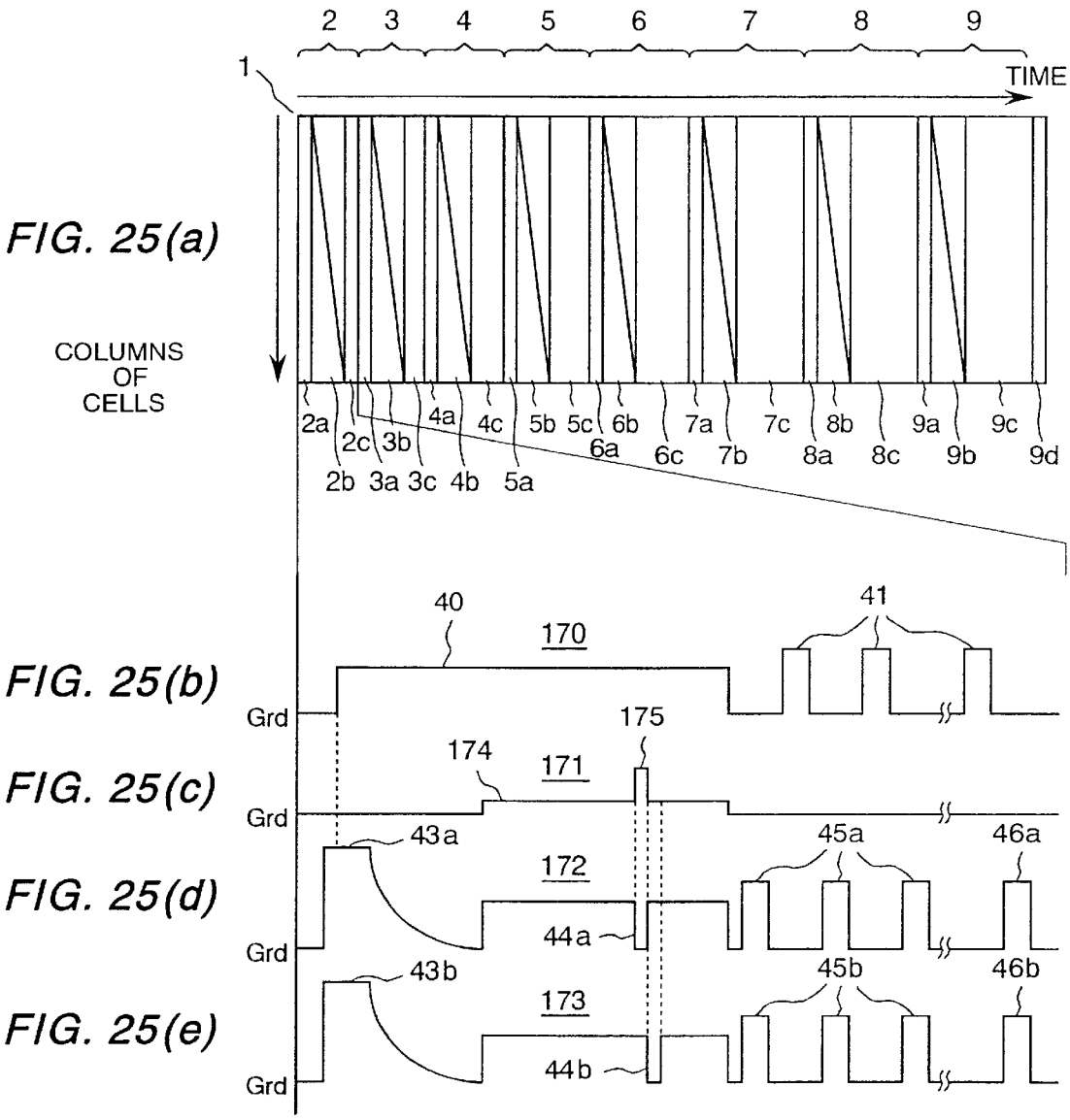
FIG. 25(*a*) is a time chart illustrating an arrangement of sub-fields in one field in accordance with the present invention.

The eleventh embodiment of the present invention is described hereinafter. FIG. 25 illustrates a eleventh driving system in accordance with a eleventh embodiment of the present invention. FIG. 25(*a*) is a time chart illustrating an arrangement of sub-fields in one field in accordance with the present invention. The figure illustrates a division of one field into several sub-fields such as the case of FIG. 5. A horizontal axis illustrates time and a vertical axis illustrates line of cells. FIG. 25(*b*)–FIG. 25(*e*) illustrate waveforms of pulses supplied to the common X electrode, the address A electrode, and the first and the second independent Y electrode respectively.

A pulse wave-form 170 illustrates a part of driving wave-form supplied to the common X electrode 22 in the first sub-field. A pulse wave-form 171 illustrates a part of driving wave-form supplied to the one of the address A electrode 29. Pulse wave-forms 172 and 173 illustrate parts of driving wave-forms supplied, for example, to a first and a second independent Y electrodes 23.

The pulse wave-form 170 which is supplied to the common X electrode 22 during the first sub-field includes a regulating pulse 40 in the period continuing from the electric charge particles equalizing period 2*a* to the address period 2*b* and the sustaining pulses 41 in the sustaining period 2*c*. The pulse wave-form 171 which is supplied to one of the address A electrodes 29 includes a voltage holding pulse 174 whose voltage is determined not to occur a discharge by the scan pulses 44*a*, 44*b*, - - - and the address pulses 42 in the address period 2*b* of the first address period 2*b* which corresponds to the light emitting cell and between the address electrode 29 and the independent Y electrode 23. The address pulses 42 is not supplied when there is no cell to be emitted. According to the present embodiment, the voltage needed for the address electric discharging is the sum of the voltage of the voltage holding pulse 174 and the voltage of address pulses 175, thereby reducing the voltage of the address pulses 175. The address pulses 175 is not supplied when there is no cell to be emitted. The pulse wave-forms 172 and 173 which are supplied to the first electrode of the independent Y electrodes 23 and adjacent second electrode of the independent Y electrodes 23 include equalizing pulses 43*a*, 43*b*, - - - in the electric charge particle equalizing period 2*a* of the first sub-field, a scan pulse 44*a*, 44*b*, - - - in the address period 2*b*, sustaining pulses 45*a*, 45*b*, - - - in the sustaining period 2*c*. The voltage of the regulating pulse 40 and the scan pulses 44*a*, 44*b*, - - - can be determined to the same voltage of sustaining pulses 41, 45*a*, 45*b*, - - - .

A condition of electric charge particles after supplying the fine line erasing pulses 46*a*, 46*b*, - - - is almost the same condition as shown in FIG. 8 which illustrates the condition of electric charge particles in accordance with the first embodiment. The condition of electric discharge in the other sub-fields 3–9 is the same condition.

Figures 26A, 26B, 26C, 26D, 26E:
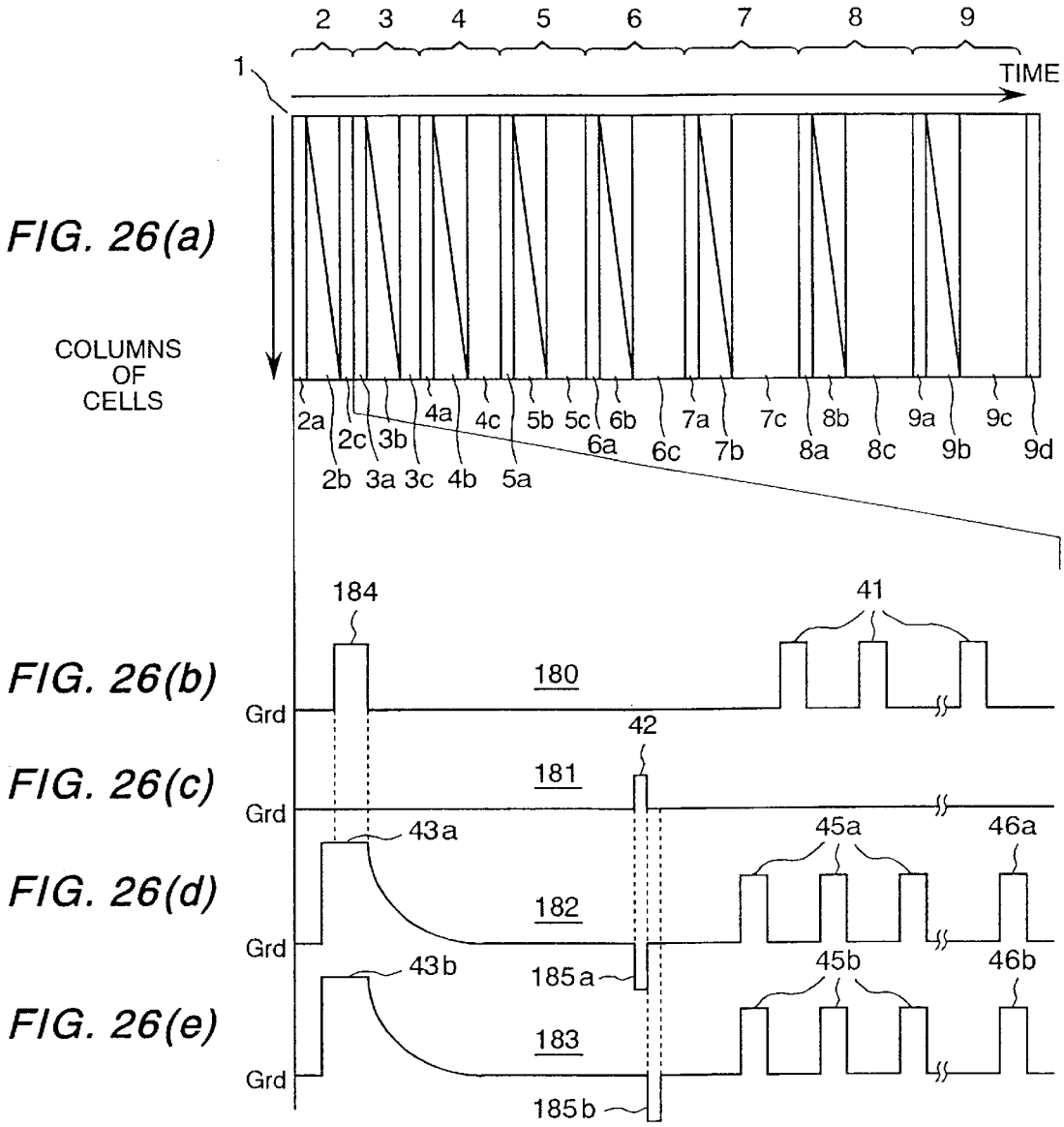
FIG. 26(*a*) is a time chart illustrating an arrangement of sub-fields in one field in accordance with the present invention.

The twelfth embodiment of the present invention is described hereinafter. FIG. 26 illustrates a twelfth driving system in accordance with a twelfth embodiment of the present invention. FIG. 26(*a*) is a time chart illustrating an arrangement of sub-fields in one field in accordance with the present invention. The figure illustrates a division of one field into several sub-fields such as the case of FIG. 5. A horizontal axis illustrates time and a vertical axis illustrates line of cells. FIG. 26(*b*)–FIG. 26(*e*) illustrate wave-forms of pulses supplied to the common X electrode, the address A electrode, and the first and the second independent Y electrode respectively.

A pulse wave-form 180 illustrates a part of driving wave-form supplied to the common X electrode 22 in the first sub-field. A pulse wave-form 181 illustrates a part of driving wave-form supplied to the one of the address A electrode 29. pulse wave-forms 182 and 183 illustrate parts of driving wave-forms supplied, for example, to a first and a second independent Y electrodes 23.

The pulse wave-form 180 which is supplied to the common X electrode 22 during the first sub-field includes a regulating pulse 184 in the electric charge particles particle equalizing period 2*a*, the sustaining pulses 41 in the sustaining period 2*c*.

The pulse wave-form 181 which is supplied to one of the address A electrodes 29 includes the address pulses 42 in the address period 2*b* of the first address period which corresponds to the light emitting cell. The address pulses 42 is not supplied when there is no cell to be emitted. The pulse wave-forms 182 and 183 which are supplied to the first electrode of the independent Y electrodes 23 and adjacent second electrode of the independent Y electrodes 23 include a equalizing pulse 43*a*, 43*b*, - - - in the electric charging equalizing period 2*a* of the first sub-field, scan pulses 137*a*, 137*b*, - - - in the address period 2*b*, sustaining pulses 185*a*, 185*b*, - - - in the address period 2*b* and sustaining pulses 45*a*, 45*b*, - - - and fine line erasing pulses 46*a*, 46*b*, - - - in the sustaining period 2*c*. The voltage of the regulating pulse 184 can be determined the same the voltage of the sustaining pulses 41.

A condition of electric charge particles after supplying the fine line erasing pulses 46*a*, 46*b*, - - - is almost same condition as shown in FIG. 8 which illustrates the condition of electric charge particles in accordance with the first embodiment. The condition of electric discharge in the other sub-fields 3–9 is the same condition. According to the present embodiment, the voltage of the scan pulses 185*a*, 185*b*, - - - is minus voltage and the voltage of the address pulses 42 is plus voltage, therefore the voltage differences becomes so large that the electric discharge is performed surely.

Figures 27A, 27B, 27C, 27D, 27E:
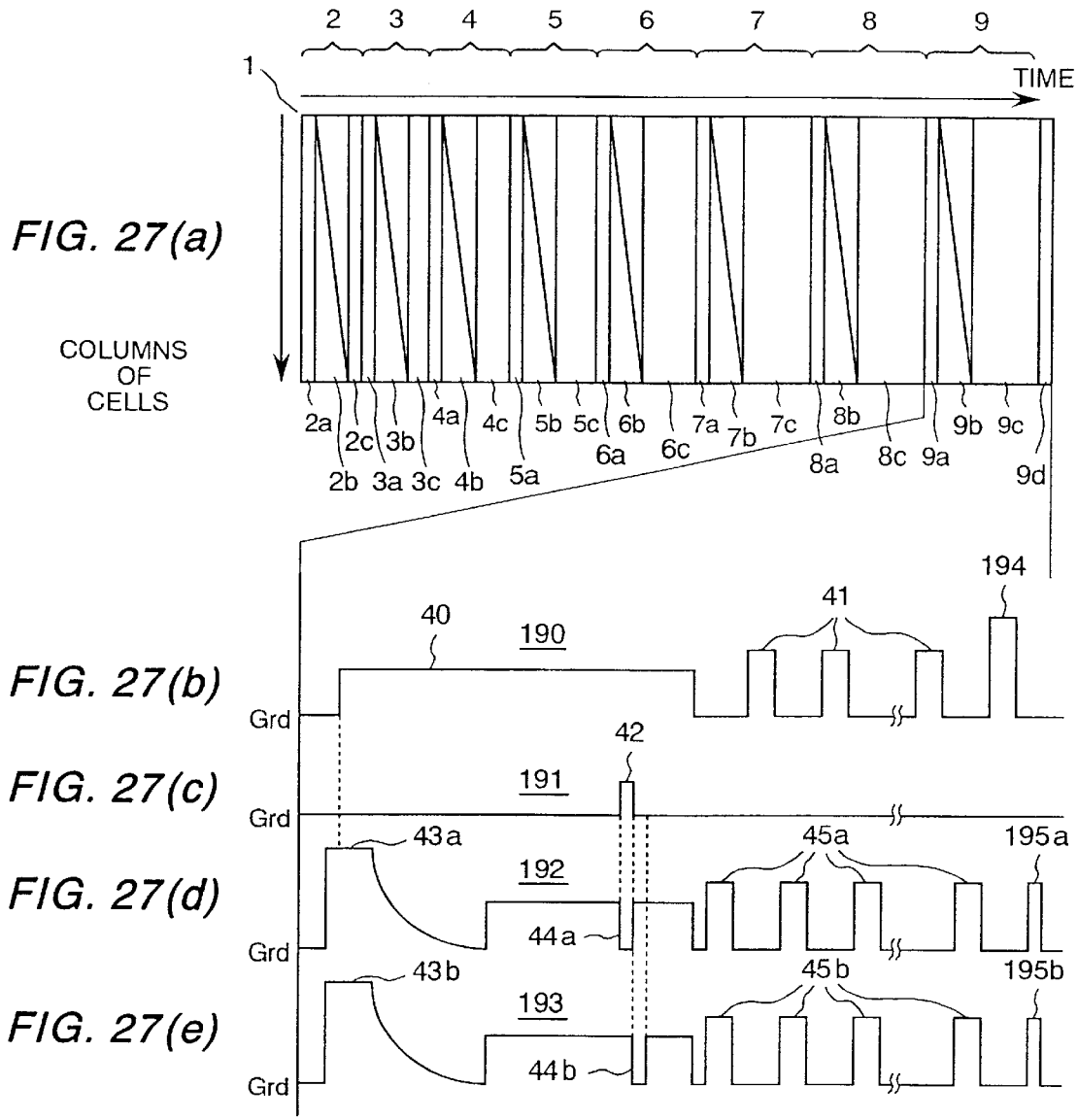
FIG. 27(*a*) is a time chart illustrating an arrangement of sub-fields in one field in accordance with the present invention.

The thirteenth embodiment of the present invention is described hereinafter. FIG. 27 illustrates a thirteenth driving system in accordance with a thirteenth embodiment of the present invention. FIG. 27(*a*) is a time chart illustrating an arrangement of sub-fields in one field in accordance with the present invention. The figure illustrates a division of one field into several sub-fields such as the case of FIG. 18. A horizontal axis illustrates time and a vertical axis illustrates line of cells. FIG. 27(*b*)–FIG. 27(*e*) illustrate wave-forms of pulses supplied to the common X electrode, the address A electrode, and the first and the second independent Y electrode respectively.

A pulse wave-form 190 illustrates a part of driving wave-form supplied to the common X electrode 22 in the first sub-field. A pulse wave-form 191 illustrates a part of driving wave-form supplied to the one of the address A electrode 29. Pulse wave-forms 192 and 193 illustrate parts of driving wave-forms supplied, for example, to a first and a second independent Y electrodes 23.

The wave-form 190 which is supplied to the common X electrode 22 during the eighth sub-field and the field blank period 9*d* thereafter includes a regulating pulse 40 in the electric charge particle equalizing period 2*a* and the address period 2*b* lasting from the equalizing period 2*a*, sustaining pulses 41 and a full writing pulse 194 in the sustaining period 2*c*. In the embodiment, the voltage of the full writing pulse 194 is higher enough to be discharged regardless the sustaining discharge is performed or not. As a result, the electric charge particles in all cells are equalized. The field blank period 9*d* can be provided between the sub-fields. And also, the field blank period 9*d* is able to arrange several times in one field. The pulse wave-form 191 which is supplied to one of the address A electrodes 29 includes the address pulses 42 in the address period 2*b*. The address pulses 42 is not supplied when there is no cell to be emitted. The pulse wave-forms 192 and 193 which are supplied to the first electrode of the independent Y electrodes 23 and adjacent second electrode of the independent Y electrodes 23 include the equalizing pulses 43*a*, 43*b*, - - - in the electric charging equalizing period 2*a*, the scan pulses 44*a*, 44*b*, - - - in the address period 2*b*, the sustaining pulses 45*a*, 45*b*, - - - in the sustaining period 2*c* and fine line erasing pulses 195*a*, 195*b*, - - - in the field blank period 9*d*. The voltage of the regulating pulse 40 and the scan pulses 44*a*, 44*b*, - - - can be determined the same as the voltage of the sustaining pulses 41. A condition of electric charge particles after supplying the fine line erasing pulses 195*a*, 195*b*, - - - is almost same condition as shown in FIG. 8 which illustrates the condition of electric charge particles in accordance with the first embodiment. The condition of electric discharge in the other sub-fields 3–9 is the same as the condition.

According to the present embodiment, any electric charge particle in the cells is not remained when black portion continues across several sub-fields, and the address electric discharges are not performed well in the coming address period. To prevent this situation, a discharges are forced by the field full writing pulse 194 between the common X electrode 22 and the independent Y electrode 23.

As explained the above, the plasma display driving system in accordance with the first through the twelfth embodiments can drive the panel without using the full writing electric discharge and erasing discharge for all the cells for equalizing the electric charge particles Still another embodiments of the present invention will be explained hereinafter.

Figures 28A, 28B, 28C, 28D, 28E, 28F, 28G:
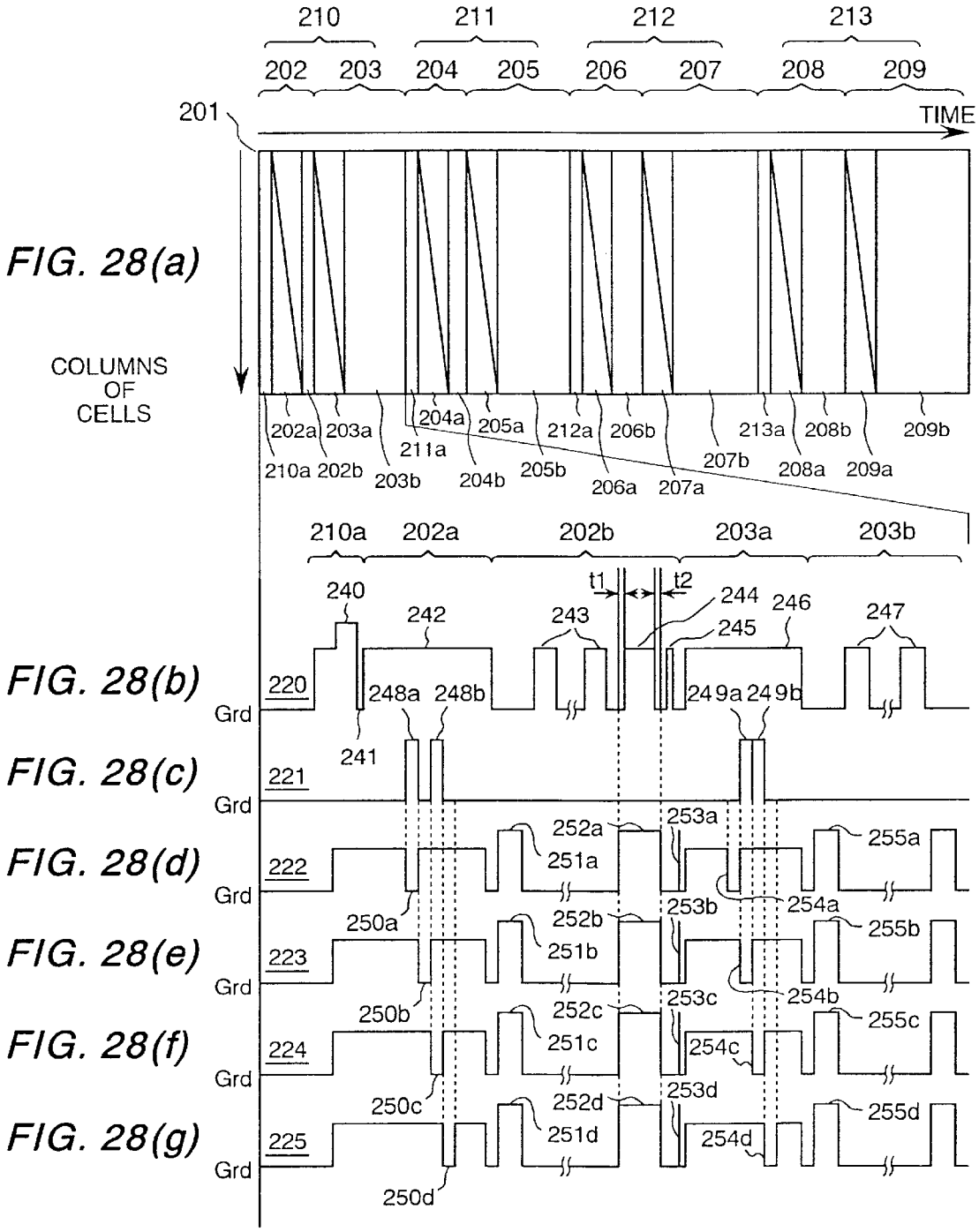
FIG. 28(*a*) is a time chart illustrating an arrangement of sub-fields in one field in accordance with a second embodiment of the present invention.

FIG. 28 illustrates driving system of a plasma display panel in accordance with a fourteenth embodiment of the present invention. FIG. 28(*a*) is a time chart illustrating an arrangement of sub-fields in the first sub-field. A horizontal axis illustrates time, and a vertical axis illustrates lines of cells. FIG. 28(*b*)–FIG. 28(*g*) are wave-forms illustrating pulse wave-forms supplied to a common X electrode, address A electrode and four independent Y electrode respectively. In the figure, reference numeral 201 denotes a field, reference numerals 202–203 denote sub-fields, reference numeral 202*a*–209*a* denote address periods, reference numeral 202*b*–209*b* denote sustaining periods, reference numeral 210–213 denote field blocks, reference numeral 210*a*–213*a* denote full writing periods. A wave-form 220 is a driving wave-form supplied to the common X electrode, A wave-form 221 is a driving wave-form supplied to the address A electrode 29, wave-forms 222–225 are driving wave-forms supplied to a first, a second, a third and a fourth electrodes of the independent Y electrodes 23.

In FIG. 28(*a*), one field period 201 is divided into eight sub-fields 202–209, one field block is arranged by two successive sub-fields, therefore one field period 201 is constructed by four field blocks.

In each field block, the full writing periods 210*a*, 211*a*, 212*a* and 213*a* which are arranged first period of sub-fields are provided in each first subfield 202, 204, 206 and 208 of the field blocks 210–213, and following the writing period 210*a*–213*a*, the address period 202*a*, 204*a*, 206*a* and 208*a* and sustaining period 202*b*, 204*b*, 206*b* and 208*b* are provided. In the second sub-fields 203, 205, 207 and 209 which follow the first sub-fields 202–208, the address period 203*a*, 305*a*, 207*a* and 209*a* are provided first, and then the sustaining period 203*b*, 205*b*, 207*b* and 209*b* are provided.

The numbers of light emitting are allotted for each sustaining period 202*b*–209*b*, and display graduations are effected by the combinations of the numbers of the light emitting. The numbers of light emitting and the order of the sub-fields are optional. In the embodiment, the numbers of light emitting of the sustaining periods 202*b*, 204*b*, 206*b*, 208*b*, 203*b*, 205*b*, 207*b* and 209*b* are arranged in this order from few numbers. The sustaining period 202*b*, 204*b*, 206*b* and 208*b* just before the sub-fields 203, 205, 207 and 209 in which the full writing erase period are not provided have fewer numbers of light emitting.

FIG. 28(*b*) illustrates the field block 210, and the other field blocks are constructed similarly. The driving wave-form 220 supplied to the common X electrode 22 includes in the first sub-field 202 a full writing pulse 240 and a polarizing pulse 241 in the first full writing erasing period 210*a*, a high pulse 242 in the succeeding address period 202*a* and sustaining pulses 243 and a electric charge particle control pulse 244 and a fine line erasing pulse 245 in the succeeding sustaining period 202*b*, and further include in the succeeding sub-field a high pulse 246 and sustaining pulses 247.

The voltage of the electric charge particle control pulse 244 and the fine line erasing pulse 245 is the same as or less than the voltage of the sustaining pulses 243. Next to the sustaining pulses 247 is the field block 211. The voltage of the full writing pulse 240 is stepped up a level. The voltage is usually determined about 300 volts, and the reason for stepping up a level is to construct the circuit simply, therefore the stepping up the voltage of full writing pulse 240 is not always necessarily.

The driving wave-form 221 supplied to the address A electrode 29 shown in FIG. 28(*a*) includes, in the first sub-field, plurality of the address pulses 248*a*, 248*b*, - - - which relates to the cells to be emitted in the address period 202*a*, and include, in the succeeding sub-field 203, plurality of address pulses 249*a*, 249*b*, - - - in the address period 203*a*.

FIG. 28(*c*)–28(*g*) are wave-forms 222,223,224 and 225 supplied to four independent Y electrodes 23 whose electrodes 23 are arranged side by side include, in the first sub-field 202, scan pulses 250*a*, 250*b*, 250*c*, 250*d*, - - - in the address period 202*a*, sustaining pulses 251*a*, 251*b*, 251*c*, 251*d*, - - - selection electric discharge pulses 252*a*, 252*b*, 252*c*, 252*d*, - - - , fine line erasing pulses 253*a*, 253*b*, 253*c*, 263*d*, - - - in the sustaining period 222*b* and include, in the succeeding sub-field 203, scan pulses 254*a*, 254*b*, 254*c*, 254*d*, - - - , in the address period 203*a*, sustaining pulses 255*a*, 255*b*, 255*c*, 255*d*, - - - in the sustaining period 203*b*.

The voltage of selection electric discharge pulses 252*a*, 252*b*, 252*c*, 252*d*, - - - is almost the same as the voltage of the electric charge particle control pulse 244, and the electric charge particle control pulse 244 rises with time lag from the rising edge of the selection electric discharge pulses 252*a*, 252*b*, 252*c*, 252*d*, - - - , and the delay time t1 is 0.1 μsec–1.5 μsec. The electric charge particle control pulse 244 falls earlier than the selection electric discharge pulses 252*a*, 252*b*, 245*c*, 252*d*, - - - . The time t2 is about 0.1 μsec–1.0 sec. The reason for setting the time lag from the rising edge of the election electric discharge pulses 252*a*–252*d* to the rising edge of the electric charge particle control pulse 244 as above mentioned is that, if the time sets longer than that, a lot of negative electric charge particles gathers on the independent Y electrode 23, and a few negative electric charge particles gathers on the common X electrode 22. Further, the reason for rising the selection electric discharge pulses 252*a*–252*d* a little earlier than the electric charge particles control pulse 244 is to cause the electric discharge by the selection electric discharging between the common X electrode 22 and independent Y electrode 23. The reason for falling the electric charge particles 244 is to defends the electric charge between the common X electrode 22 and the independent Y electrode 23 when the selection electric discharge pulses 252*a*–252*d* falls.

The selection electric discharge pulses 252*a*, 252*b*, 252*c*, 252*d*, - - - , the fine line erasing pulses 253*a*, 253*b*, 253*c*, 253*d*, - - - and the electric discharge particle control pulse 244 are not provided in the succeeded sub-field 203 of the field block 210 of FIG. 28(*a*).

The sustaining pulses of the sub-field 203 terminate with the sustaining pulses 255*a*, 255*b*, 255*c*, 255*d*, - - - supplied to the independent Y electrodes 23.

The same driving wave-forms are used in the other field blocks 211–213, but the numbers of the sustaining pulses are different. The selection electric discharge pulses, the electric charge particle control pulse and the fine line erasing pulses are provided in the first sub-field 204, 206, 208 of the field blocks 210–213.

The function of the embodiment is explained with FIG. 29–FIG. 32.

The electric discharges occur in all the cells by the full writing pulse 240 supplied to the common X electrode 22 in the field block 210 of FIG. 28(*a*)–FIG. 28(*b*) and the electric charge particles are formed. Under these circumstances, the negative electric charge particles 61 are gathered on the address A electrode 29 side. The electric discharge for polarization occurs by the polarization pulse 241, and electric discharge particles on the common X electrode 22 side and the independent Y electrode 23 side are polarized.

The scan pulses 250*a* of the wave-form 222 are supplied to the first line of the independent Y electrode 23 and at the same time, the address pulses 248*a* are supplied to the predetermined address A electrode 29 in the succeeded address period 202*a*, thereby generating full writing electric discharge and forming the electric charge particles in the cell positioned at the cross point of first line of the independent Y electrode 23 and the address A electrode 29, and the positive electric charge particles are gathered on the independent Y electrode 23 side in the cell.

In a similar way, when the scan pulses 250*c* of the driving wave-form 224 are supplied to the third independent Y electrode 23 and the address pule 248*b* is supplied to predetermine address A electrode 29, thereby generating full writing electric discharge and forming the electric charge particles in the cell positioned at the cross point of the third line of the independent Y electrode 23 and the address A electrode 29, and the positive electric charge particles 60 are gathered on the independent Y electrode 23 side in the cell.

The address pulses which correspond to the scan pulses 250*b*, 250*d* of the driving wave-form 223, 225 supplied to the second and the fourth independent Y electrode 23 are not supplied when the predetermined cells are not emitted, therefore, writing electric discharges do not occur and electric charge particle is not formed on the independent Y electrode 23 side.

The sustaining discharge or light emitting discharge in the sustaining period 202*b* occurs by the sustaining pulses 234 of the driving wave-form 220 and the sustaining pulses 251*a*, 251*b*, 251*c*, 251*d*, - - - , of the driving wave-forms 222, 223, 224, 225 in the cell in which the positive electric charge particles are gathered on the independent Y electrode 23 side.

The optional or selecting electric discharges occur by the selection electric discharge pulses 252*a*, 252*b*, 252*c* and 252*d* in the cell in which the sufficient electric charge particles are formed by the electric discharge for light emitting. The positive electric discharge particles 60 are gathered on the address A electrode 29 side by supplying electric charge particle control pulse 244 to the common X electrode 22 before the electric discharges by the selection electric discharge pulses 252*a*, 252*b*, 252*c*, 252*d*, - - - , cease.

After that, the erasing electric discharge is caused by the fine line erasing pulse 245 of the wave-form 220 supplied to the common X electrode 22 and the fine line erasing pulses 253*a*, 253*b*, 253*c*, 253*d*, - - - , of the wave-form 222 supplied to the independent Y electrode 23, and the electric charge particles on the common X electrode 22 side and on the independent Y electrode 23 side are mainly erased. Thereby, the condition of the electric charge particles in all cells in which the electric discharges are caused is almost same as the condition of the electric charge particles after the full writing erasing period 210*a* is finished.

On the other hand, the writing electric discharges or the address electric discharges are not caused in the cells in which the electric discharges for light emitting are not caused and the condition of electric charge particles are the same condition after the full writing erasing period 210*a* is finished.

As explained above, the electric charge particles in all cells at a point of time after the final erasing pulses 245, 253*a*, 253*b*, 253*c*, 253*d*, - - - , are supplied in the first sub-field 202 can be made the same condition after the full writing erasing period 210*a* is finished. By this, in the succeeding sub-field, address electric discharges in all the cell can be caused without providing a full writing erasing period.

The same functions are repeated in the field blocks 211–213, and a screen of one field is constructed.

FIG. 29–FIG. 32 are sectional views of plasma display panel illustrating a condition of the electric charge particles in a cell in which a sustaining discharge is performed. Referring now to the drawing, wherein like numerals are utilized to designate like parts throughout the several views, reference numeral 60 denotes a positive electric charge particles and reference numeral 61 denotes negative electric charge particles. The condition of the electric charge particles in the drawings is illustrated in a center cell of three cells.

Figure 29:
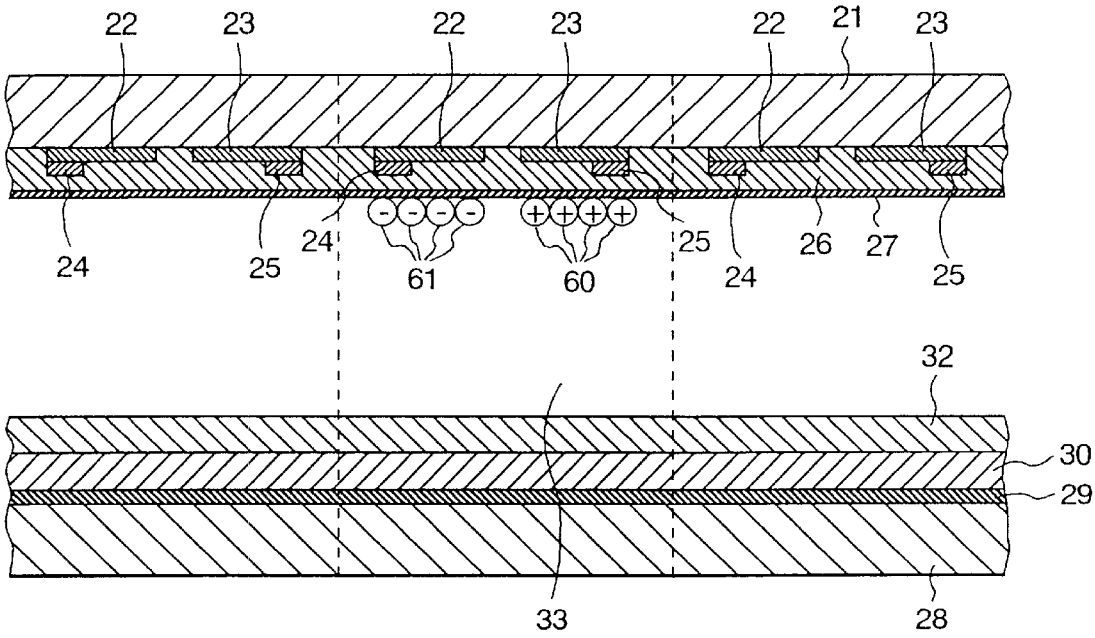
FIG. 29 is a sectional view of a plasma display panel in which a condition of electric charge particles in a cell after supplying sustaining pulses is illustrated in accordance with a embodiment shown in FIGS. 28(*a*)–28(*g*) of the present invention.

FIG. 29 is a sectional view of a plasma display panel in which a condition of electric charge particles in a cell after supplying sustaining pulses is illustrated in accordance with a embodiment shown in FIG. 28(*a*)–28(*e*) of the present invention. The negative electric charge particles 61 are gathered on the dielectric layer 26 of the common X electrode 22 side and the positive electric charge particles 60 are gathered on the dielectric layer 26 of the independent Y electrode 23 side after a final pulse of the sustaining pulses 243 is supplied to the common X electrode 22.

Figure 30:
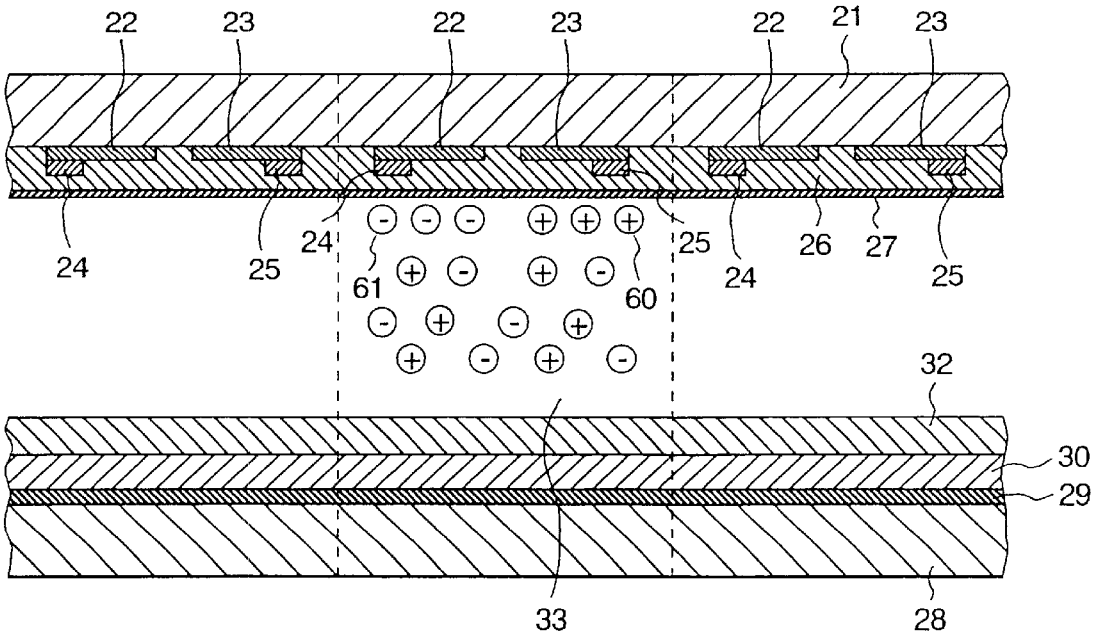
FIG. 30 is a sectional view of a plasma display panel in which a condition of electric charge particles in a cell during discharging by a selection electric discharge pulse is illustrated in accordance with the embodiment shown in FIG. 28(*a*)–28(*g*) of the present invention.

FIG. 30 is a sectional view of a plasma display panel in which a condition of electric charge particles in a cell during discharging by a selection electric discharge pulse is illustrated in accordance with the embodiment shown in FIG. 28(*a*)–28(*e*) of the present invention. Electric discharges are caused by the voltage of the selection electric discharge pulses 252*a*, 252*b*, 252*c*, 252*d*, - - - and the voltage of positive electric charge particles gathered on the dielectric layer at the independent Y electrode 23 and caused between the independent Y electrode 23 and the common X electrode 22 when selection electric discharge pulses 252*a*, 252*b*, 252*c*, 252*d*, - - - , are supplied to the independent Y electrode. Thereby many positive and negative electric charge particles are generated in the discharging space.

Figure 31:
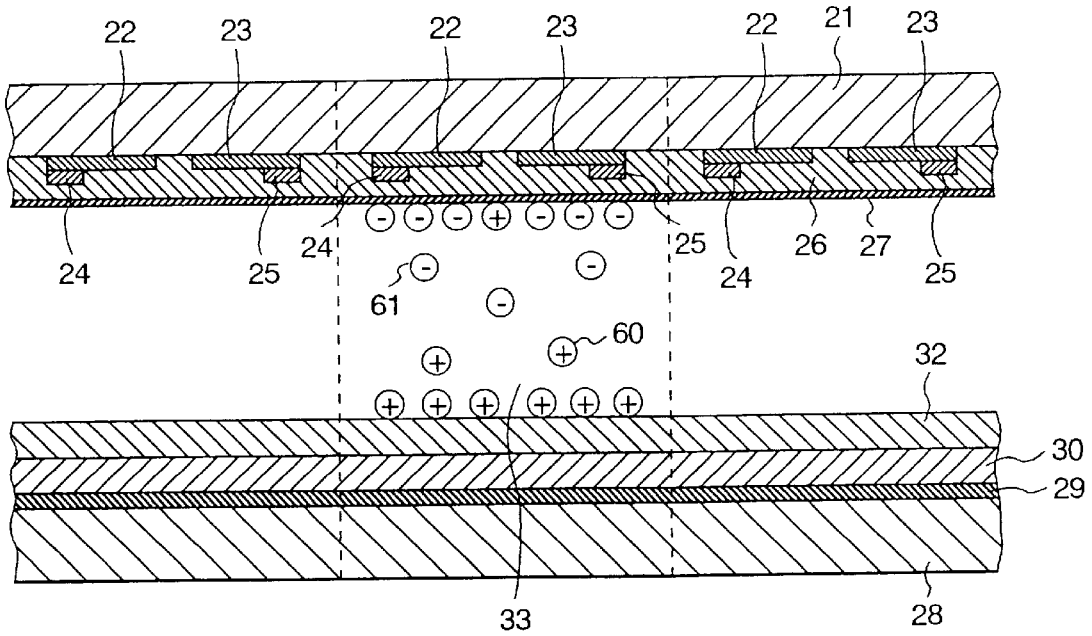
FIG. 31 is a sectional view of a plasma display panel in which a condition of electric charge particles in a cell during supplying electric charge particles control pulse is illustrated in accordance with the embodiment shown in FIG. 28(*a*)–28(*g*) of the present invention.

FIG. 31 is a sectional view of a plasma display panel in which a condition of electric charge particles in a cell when electric charge particle control pulse is supplied is illustrated in accordance with the embodiment shown in FIG. 28(*a*)–28(*e*) of the present invention. The positive electric charge particles are gathered on the address A electrode 29 when the electric charge particle control pulse 244 is supplied to the common X electrode 22 because the voltages of the common X electrode 22 and the independent Y electrode 23 are almost same and the voltages are higher than the voltage of address A electrode 29. Erasing of electric charge particles by erase pulse are still needed because there still remains electric charge particles on the common X electrode 22 side, on the independent Y electrode 23 side and in the discharging space which are not neutralized and not erased.

Figure 32:
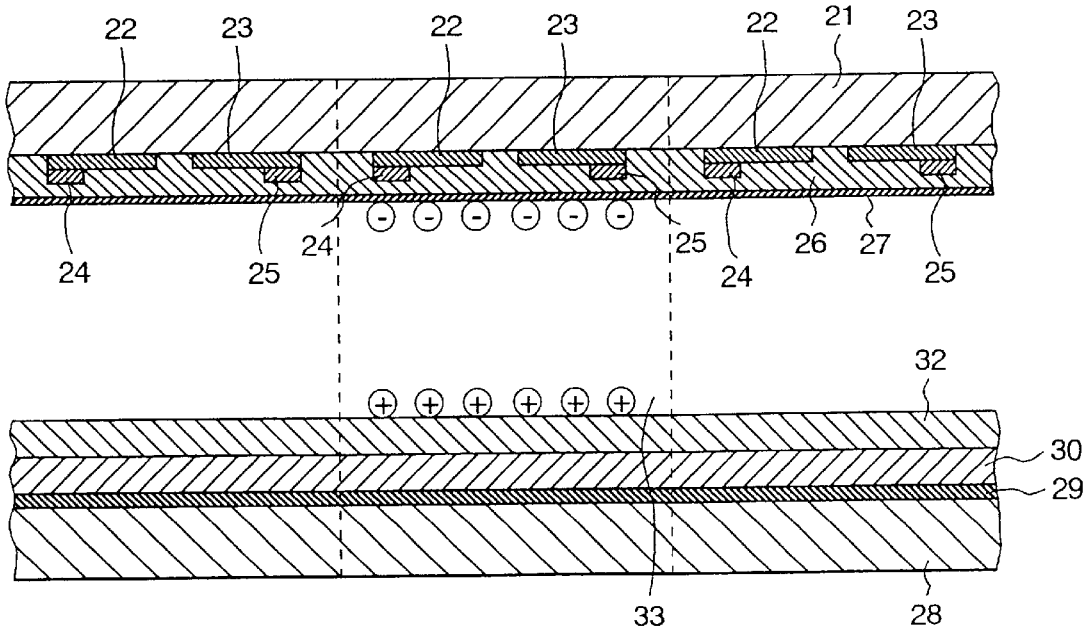
FIG. 32 is a sectional view of a plasma display panel in which a condition of electric charge particles in a cell after supplying a fine line erasing pulse is illustrated in accordance with the embodiment shown in FIG. 28(*a*)–FIG. 28(*g*) of the present invention.

FIG. 32 is a sectional view of a plasma display panel in which a condition of electric charge particles in a cell after supplying a fine line erasing pulse is illustrated in accordance with the embodiment shown in FIG. 28(*a*)–28(*e*) of the present invention. The positive electric charge particles 60 are gathered on the address A electrode 29 side and the negative electric charge particles 61 are gathered on the common X electrode 22 side and the independent Y electrode 23 side. The condition of electric charge particles is the same after the full writing erase period 210*a* is finished.

A condition of electric charge particles after the full writing erasing period 210*a* is finished is maintained in the sustaining period 202*b* because the address electric discharges are not performed in the cells in which no sustaining electric discharge is performed. Also, any electric discharge is not performed by the selection electric discharge pulses 252*a*, 252*b*, 252*c*, 252*d*, - - - , and there is no change in the condition of electric charge particles even if electric charge particle control pulse 244 and erasing pulse are supplied. Therefore, the condition of electric charge particles in all cells is almost same as the condition after the full writing erasing period 210*a* and the address electric discharge or a writing electric discharge is caused in next sub-field 203, thereby increasing the contrast by double.

By increasing the voltage of the address pulses 249*a* and 249*b* in the sub-field 203, 205, 207, 209 in which the full writing erasing period is not arranged, comparing with the voltage of the address pulses 249*a* and 249*b* in the other sub-field 202, 204, 206 and 208, the address electric discharges are caused surely even in the cell in which sustaining electric discharges are not performed, because the positive electric charge particles 60 on the address A electrode 29 side are reduced gradually by neutralization.

Figure 33:
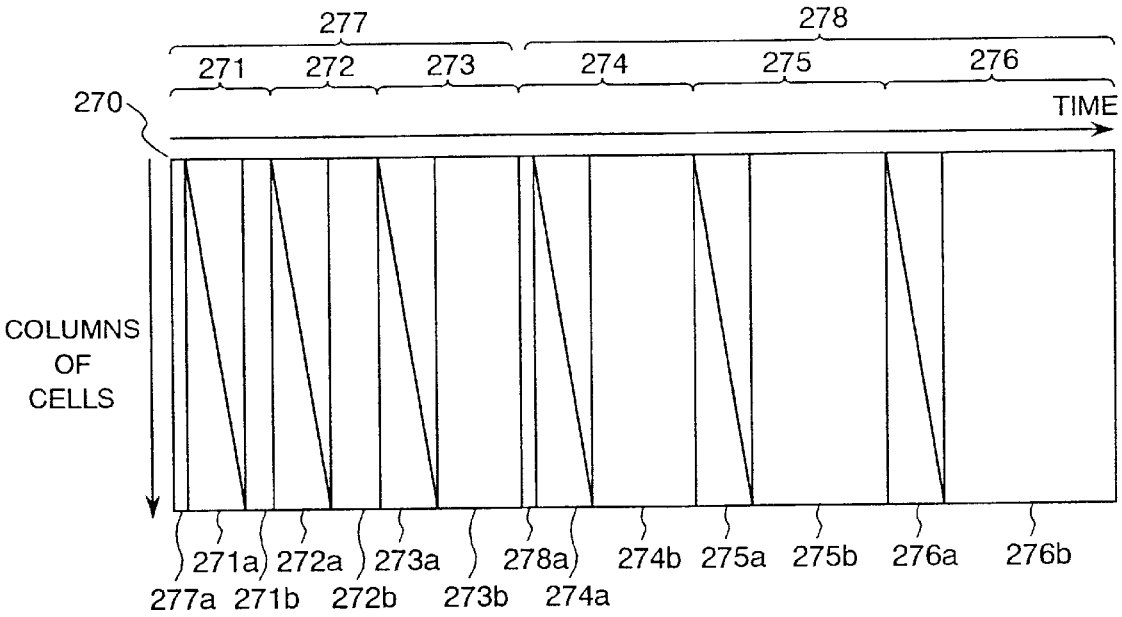
FIG. 33 is a time chart of sub-fields illustrating a driving system in accordance with a third embodiment of the present invention.

FIG. 33 is a time chart of sub-fields illustrating a driving system in accordance with a third embodiment of the present invention. Referring to the drawing, a horizontal axis illustrates time, and a vertical axis illustrates lines of cells. Reference numeral 270 denotes one field period, 271–276 denote sub-fields, 271*a*–276*a* denote address periods, 271*b*276*b* denote sustaining periods, 277 and 278 denote field blocks, 277*a* and 278*a* denote full writing erasing periods.

One field period 270 is divided into six subfields 271–276, and consecutive first three sub-fields 271–273 construct the field block 277 and succeeding consecutive three sub-fields 274–276 construct the other field block 278.

In the first period of these field blocks 277 and 278, the full writing erasing period 277*a* and 278*a* are arranged. In each sub-field 217–276, the address period 271*a*–276*a* and the sustaining period 271*b*–276*b* are arranged but the full writing erasing period 277*a* and 278*a* are not provided. That is, the full writing erasing period 277*a* and 278*a* are arranged at the first part of the first sub-fields 271 and 274 of the field blocks 277 and 278. The numbers of the light emitting are allotted for the sustaining period 271*b*–276*b*, and gradations of display are performed by the combining of the numbers of the light emitting. According to the fifteenth embodiment, the numbers of the light emitting are increased in order of the sub-fields 271, 272, 273.

The selection electric discharge pulse 252*a*–252*d*, the electric charge particle control pulse 244 and fin line erasing pulse 245, 253*a*–253*b* which are used in the fourteenth embodiment are provided in the first two sub-fields 271, 272, 274, 275 of each field blocks 277 and 278, and these pulses are not provided in the other(last) sub-field. Further, these selection electric discharge pulses, electric charge particle control pulse and fine line erasing pulses are arranged in the last part of the sustaining period 271*b*, 272*b*, 274*b* and 275*b*, thereby the condition of electric charge particles in all cells after sustaining period 271*b*, 272*b*, 274*b* and 275*b* are finished is maintained the same condition after the full writing erasing period 277*a* is finished, so the full writing erasing period 210*a* is deleted in the sub-fields 272, 273, 275 and 276 other than the first sub-fields 271 and 274, and the address electric discharges are performed in the address period 272*a*, 273*a*, 275*a* and 276*a* without supplying the selection electric discharge pulses 252*a*–252*d* and electric charge particle control pulse 244 in the last sub-field. Therefore, the contrast is multiplied by three.

Figure 34:
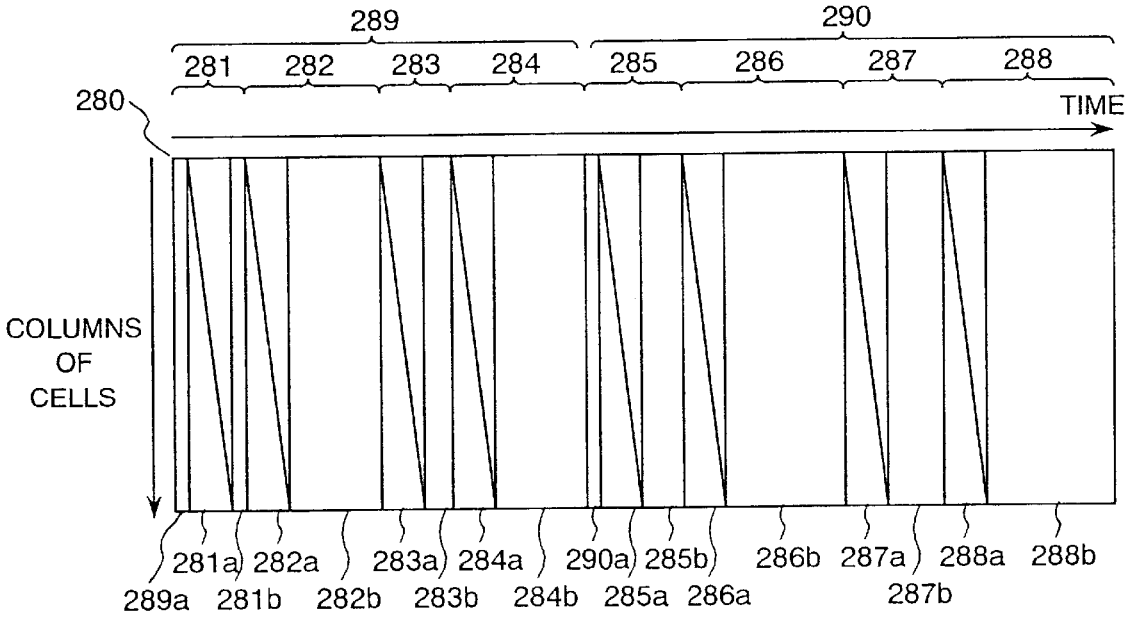
FIG. 34 is a time chart of sub-fields illustrating a driving system in accordance with a fourth embodiment of the present invention.

FIG. 34 is a time chart of sub-fields illustrating a driving system in accordance with a fifteenth embodiment of the present invention. Referring to the drawing, a horizontal axis illustrates time, and a vertical axis illustrates lines of cells. Reference numeral 280 denotes one field period, 281–286 denote sub-fields, 281*a*–288*a* denote address periods,

281*b*–288*b* denote sustaining periods, 289 and 290 denote field blocks, 289*a* and 290*a* denote full writing erasing periods.

One field period 280 is divided into eight sub-fields 281–288, and consecutive first four sub-fields 281–284 construct the field block 289 and succeeding consecutive four sub-fields 285–288 construct the other field block 290.

The first period of these field blocks 289 and 290 include the full writing erasing period 289*a* and 290*a*, and the address period 281*a*–288*a* and the sustaining period 281*b*–288*b* are arranged in each sub-field 281–288. That is, the full writing erasing period 289*a* and 290*a* are arranged at the first part of the first sub-fields 281 and 285 of the field blocks 289 and 290. The numbers of the light emitting are allotted for the sustaining periods 281*b*–288*b*, and gradations of display are performed by the combining the numbers of the light emitting. According to the sixteenth embodiment, the numbers of the light emitting are increased in order of the sub-fields 281, 282, 283, - - - .

The selection electric discharge pulse 252*a*–252*d*, the electric charge particle control pulse 244 and fin line erasing pulse 245, 253*a*–253*b* which are used in the fourteenth embodiment are provided in the sustaining period 281*b*, 282*b*, 283*b*, 285*b*, 286*b* and 287*b* of the first three sub-fields 281, 282, 284, 285, 286 and 287 in each field blocks 287 and 290, and these pulses are not provided in the other(last) sub-field.

The condition of electric charge particles in all cells after sustaining period 281*b*, 282*b* and 283*b* of the sub-fields 281, 282 and 283 in the field block 289 and sustaining periods 285*b*, 286*b* and 287*b* of the subfields 285, 286 and 287 in the field block 290 are finished is maintained the same condition after the full writing erasing period 289*a* is finished, so the full writing erasing periods 210*a* are deleted in the three sub-fields 282, 283, 284, 286, 287 and 288 other than the first sub-fields 281 and 285, and the address electric discharges are performed in the address period 282*a*, 273*a*, 284*a*, 286*a*, 287*a* and 288*a* without supplying the selection electric discharge pulses 252*a*–252*d* and electric charge particle control pulse 244 in the last sub-field. Therefore, the contrast is multiplied by four.

Figure 35:
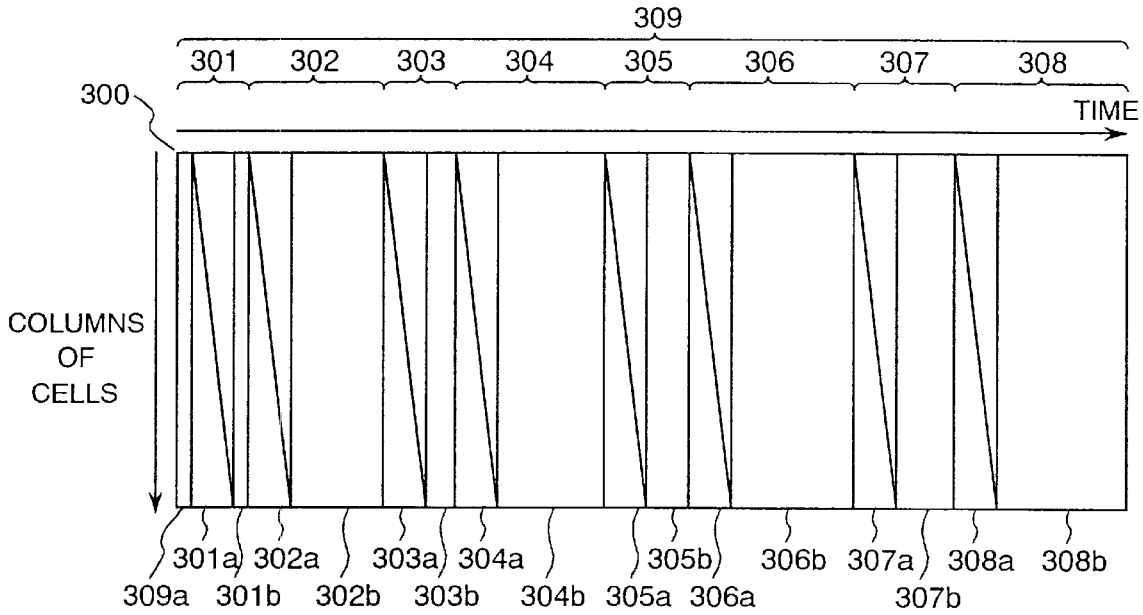
FIG. 35 is a time chart of sub-fields illustrating a driving system in accordance with a fifth embodiment of the present invention.

FIG. 35 is a time chart of sub-fields illustrating a driving system in accordance with a seventeenth embodiment of the present invention. Referring to the drawing, a horizontal axis illustrates time, and a vertical axis illustrates lines of cells. Reference numeral 300 denotes one field period, 301–308 denote sub-fields, 301*a*–308*a* denote address periods, 301*b*–308*b* denote sustaining periods, 309 denote field blocks, 309 denote a full writing erasing period.

One field period 300 is divided into eight sub-fields 301–308, and the field block 309 is constructed by all sub-fields 301–308 in the one field. The first period of these field blocks 309 includes the full writing erasing period 309*a*. The address period 301*a*–308*a* and the following sustaining period 301*b*–308*b* are arranged in each sub-field 301–308. That is, the full writing erasing period 309*a* are arranged at the first part of the first sub-fields 302. The numbers of the light emitting are allotted for the sustaining period 301*b*–308*b* and gradations of display are performed by the combining the numbers of the light emitting.

The selection electric discharge pulses 252*a*–252*d*, the electric charge particle control pulses 244 and fin line erasing pulses 245, 253*a*–253*b* which are used in the fourteenth embodiment are provided in the sustaining periods 301*b*–307*b* of the first seven sub-fields 301–307, and the full writing erasing period 309*a* is arranged only in the first sub-field 301. The address electric discharges in these address periods 302*a*–308*a* are possible, even if the full writing erasing periods 309*a* in the sub-fields 302–308 which follow the first sub-field 301 is deleted. Thereby the contrast is multiplied by eight.

According to these embodiments, by deleting full writing erasing period in some sub-field, the contrast is improved. The practical contrast of cathode ray tube display is, for example, 150:1, and in the plasma display according to the embodiments shown in FIG. 33 or FIG. 34, corresponding contrast is accomplished.

The numbers of sub-fields in one field and the numbers of the sub-fields in one field block are optional and not limited above mentioned embodiments, and any combination will be applicable.

According to the present invention, full writing electric discharge and erasing electric discharge are deleted or reduced, thereby improving the contrast of the display.

According to the present invention, full writing erasing period can be arranged one time per several sub-fields, thereby improving the contrast.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such change and modifications as are encompassed by the scope of the appended claims.

What we claim is:

1. A plasma display panel driving method for a display panel having a plurality of electrodes forming cells, including a first electrode group arranged on a permeable substrate and being capable of being driven in common, a second electrode group arranged in parallel with said first electrode group on said permeable substrate and being capable of being driven independently, a third electrode group arranged perpendicular to said first and second electrode groups on another substrate and being capable of being driven independently, said driving method comprising the steps of:

supplying a voltage with a fast rising leading edge so as to immediately produce a maximum electric discharge one time per a sub-field in a cell in which an electric discharge was performed beforehand; and supplying another voltage without causing any electric discharge under a first condition;

wherein the step of supplying another voltage without causing any electric discharge under a first condition includes supplying the another voltage with a polarity which is the same polarity and a value which is larger than a polarity and value of the voltage supplied with a fast rising leading edge.

2. A plasma display panel driving apparatus for a display panel having a plurality of cells, comprising:

a first electrode group arranged on a permeable substrate and being capable of being driven in common;

a second electrode group arranged in parallel with said first electrode group on said permeable substrate and being capable of being driven independently;

a third electrode group arranged perpendicular to said first and second electrode groups on another substrate and being capable of being driven independently; and a circuit for supplying a voltage with a fast rising leading edge so as to immediately produce a maximum electric discharge one time per a sub-field in a cell in which an electric discharge was performed beforehand and for supplying another voltage without causing any electric discharge under a first condition;

wherein the another voltage which is supplied without causing any electric discharge under a first condition is a voltage having a polarity which is the same polarity and a value which is larger than a polarity and value of the voltage supplied with a fast rising leading edge.

3. A plasma display having a plurality of cells, comprising:

a first electrode group arranged on a permeable substrate and being capable of being driven in common;

a second electrode group arranged in parallel with said first electrode group on said permeable substrate and being capable of being driven independently; and a third electrode group arranged perpendicular to said first and second electrode groups on another substrate and being capable of being driven independently;

a circuit for supplying a voltage with a fast rising edge so as to immediately produce a maximum electric discharge one time per a sub-field in a cell to which the electric discharge was performed beforehand and for supplying another voltage without causing any electric discharge under a first condition, thereby improving linearity of display gradation;

wherein the another voltage which is supplied without causing any electric discharge under a first condition is a voltage having a polarity which is the same polarity and a value which is larger than a polarity and value of the voltage supplied with a fast rising leading edge.

4. A plasma display panel driving method for a display panel having a plurality of electrodes forming cells, including first electrode group arranged on a first substrate and being capable of being driven in common, a second electrode group arranged in parallel with said first electrode group on said first substrate and being capable of being driven independently, a third electrode group arranged perpendicular to said first and second electrode groups on a second substrate and being capable of being driven independently, said driving method comprising the steps of:

generating a sustaining electric discharge by supplying a sustaining pulse to said first and said second electrode groups;

polarizing electrically charged particles in a cell by supplying a fine line erasing pulse having a fast rising edge to one of said first and said second electrode groups so as to immediately produce a maximum electric discharge;

gathering electrically charged particles having one of the polarities in the vicinity of said first and said second electrode groups, gathering said electrically charged particles having the other polarity in the vicinity of said third electrode group by supplying an equalizing pulse to said one of electrode groups, and by supplying a regulating pulse rising later than said equalizing pulse to the other electrode group of said first and said second electrode groups without producing an electric discharge under a first condition;

wherein the equalizing pulse has a polarity which is the same polarity and a voltage value which is higher than a polarity and voltage value of the fine line erasing pulse.

5. A plasma display panel driving circuit comprising:

a first electrode group arranged on a first substrate and driven in common;

a second electrode group arranged parallel to said first electrode group on said first substrate and controlled independently;

a third electrode group arranged perpendicular to said first and second electrode groups on a second substrate facing said first substrate and controlled independently;

a first driving circuit connected to said first electrode group for supplying a first driving pulse;

a second driving circuit connected to said second electrode group for supplying a second driving pulse; and a third driving circuit connected to said third electrode group for supplying an address driving pulse;

wherein said second driving circuit supplies a fine line erasing pulse having a fast rising leading edge to said second electrode group after sustaining discharging so as to immediately produce a maximum electric discharge, said second driving circuit further supplies an equalizing pulse to said second electrode group and said first driving circuit supplies a regulating pulse which is delayed from the rising edge of said equalizing pulse to the other electrode group of said first and said second electrode groups, gathers electrically charged particles having one of opposite polarities in the vicinity of said first and said second electrode groups and gathers electrically charged particles having the other polarity in the vicinity of said third electrode group; and wherein the equalizing pulse has a polarity which is the same polarity and a voltage value which is higher than a polarity and voltage value of the fine line erasing pulse.

6. A plasma display comprising:

a first electrode group arranged on a first substrate and driven in common;

a second electrode group arranged parallel to said first electrode group on said first substrate and controlled independently;

a third electrode group arranged perpendicular to said first and second electrode groups on a second substrate facing said first substrate and controlled independently;

a plurality of cells constructed at the cross points of said first and said second and said third electrode groups;

a first circuit for generating a discharge using a fine line erasing pulse having a fast rising leading edge supplied to one of the electrodes of said first and said second electrode groups after a sustaining discharge so as to immediately produce a maximum electric discharge for erasing and polarizing electrically charged particles generated in cells in which said sustaining discharge was generated and for supplying an equalizing pulse; and a second circuit for supplying a regulating pulse so as to gather electrically charged particles having one of opposite polarities in the vicinity of said first and said second electrode groups and to gather electrically charged particles having the other one of the polarities in the vicinity of said third electrode group by supplying said equalizing pulse to said one of the electrodes and by supplying said regulating pulse to the other of said first and said second electrode groups so as to be able to produce a discharge for addressing which determines light emitting cells by said third electrode group;

wherein the equalizing pulse has a polarity which is the same polarity and a voltage value which is higher than a polarity and voltage value of the fine line erasing pulse.

7. A plasma display panel driving method for a display panel having a plurality of electrodes forming cells, including a first electrode group arranged on a first substrate and being capable of being driven in common, a second electrode group arranged in parallel with said first electrode group on said first substrate and being capable of being driven independently, a third electrode group arranged perpendicular to said first and second electrode groups on a second substrate and being capable of being driven independently, said driving method comprising the steps of:

supplying an equalizing pulse under one condition for producing an electric discharge one time in cells other than when an abnormal state occurs in said cells after supplying power for generating electrically charged particles;

gathering electrically charged particles having one of the polarities in the vicinity of said first and said second electrode groups and gathering said electrically charged particles having the other polarity in the vicinity of said third electrode group by supplying a regulating pulse;

producing address electric discharge by supplying an address pulse to said third electrode group for selecting cells to be illuminated;

generating a sustaining electric discharge by supplying a sustaining pulse to said first and said second electrode groups, polarizing electrically charged particles in a cell by supplying a fine line erasing pulse having a fast rising leading edge to one of said first and said second electrode groups one time per a sub-field so as to immediately produce a maximum electric discharge; and gathering electrically charged particles having one of the polarities in the vicinity of said first and said second electrode groups and gathering said electrically charged particles having the other polarity in the vicinity of said third electrode group by supplying said equalizing pulse under another condition to said one of electrode groups and by supplying said regulating pulse rising later than said equalizing pulse to the other electrode group of said first and said second electrode groups without producing an electric discharge;

wherein the equalizing pulse has a polarity which is the same polarity and a voltage value which is higher than a polarity and voltage value of the fine line erasing pulse.

8. A plasma display panel driving circuit comprising:

a first electrode group arranged on a first substrate and driven in common;

a second electrode group arranged parallel to said first electrode group on said first substrate and controlled independently;

a third electrode group arranged perpendicular to said first and second electrode groups an a second substrate facing said first substrate and controlled independently;

a first driving circuit connected to said first electrode group for supplying a first driving pulse;

a second driving circuit connected to said second electrode group for supplying a second driving pulse; and a third driving circuit connected to said third electrode group for supplying an address driving pulse;

wherein said second driving circuit is arranged for supplying an equalizing pulse under one condition for producing an electric discharge one time in cells other than when an abnormal state occurs in said cells after supplying power for generating electrically charged particles;

said first driving circuit is arranged for supplying a regulating pulse for gathering electrically charged particles having one of the polarities in the vicinity of said first and said second electrode groups and gathering said electrically charged particles having the other polarity in the vicinity of said third electrode group;

said third driving circuit is arranged for supplying an address pulse to said third electrode group for producing address electric discharge to select cells to be illuminated;

said first driving circuit is arranged for supplying a sustain pulse to said first electrode group and said second driving circuit is arranged for supplying a sustain pulse to said second electrode group for generating sustain discharge;

said second driving circuit is arranged for supplying a fine line erasing pulse having a fast rising leading edge to one of said first and second electrode groups after sustaining discharging so as to immediately produce a maximum electric discharge; and said second driving circuit is arranged for supplying said equalizing pulse under another condition to said one electrode group without discharging, and said first driving circuit is arranged for supplying said regulating pulse which is delayed from the rising edge of said equalizing pulse to the other electrode group of said first and said second electrode groups for gathering electrically charged particles having one of opposite polarities in the vicinity of said first and said second electrode groups and for gathering electrically charged particles having the other polarity in the vicinity of said third electrode group;

wherein the equalizing pulse has a polarity which is the same polarity and a voltage value which is higher than a polarity and voltage value of the fine line erasing pulse.

9. A plasma display comprising:

a first electrode group arranged on a first substrate and driven in common;

a second electrode group arranged parallel to said first electrode group on said first substrate and controlled independently;

a third electrode group arranged perpendicular to said first and second electrode groups on a second substrate provided faced on said first substrate and controlled independently;

a plurality of cells constructed at the cross points of said first and said second and said third electrode groups;

a first circuit arrangement for supplying an equalizing pulse under one condition for producing an electric discharge one time in cells other than when an abnormal state occurs in said cells after supplying power for generating electrically charged particles;

a second circuit arrangement for supplying a regulating pulse for gathering electrically charged particles having one of the polarities in the vicinity of said first and said second electrode groups and gathering said electrically charged particles having the other polarity in the vicinity of said third electrode group; and a third circuit arrangement for supplying an address pulse to said third electrode group for producing address electric discharge to select cells to be illuminated;

said first circuit arrangement is arranged for supplying a sustain pulse to said second electrode group and said second circuit arrangement is arranged for supplying a sustain pulse to said first electrode group for generating sustain discharge;

said first circuit arrangement is arranged for supplying a fine line erasing pulse to one of said first and second electrode groups after sustaining discharging; and said first circuit arrangement is arranged for generating a discharge using a fine line erasing pulse having a fast rising leading edge supplied to one of the electrodes of said first and said second electrode groups after a sustaining discharge so as to immediately produce a maximum electric discharge for erasing and polarizing electrically charged particles in cells in which said sustaining discharge was generated; and said first and second circuit arrangements are arranged for gathering electrically charged particles having one of polarities in the vicinity of said first and said second electrode groups and for gathering electrically charged particles having the other one of the polarities in the vicinity of said third electrode group by supplying said equalizing pulse under another condition to said one of the electrodes without electric discharging and by supplying a regulating pulse to the other of said first and said second electrode groups so as to be able to produce a discharge for addressing which determines light emitting cells by said third electrode group;

wherein the equalizing pulse has a polarity which is the same polarity and a voltage value which is higher than a polarity and voltage value of the fine line erasing pulse.

* * * * *